US009640109B2

(12) United States Patent
Yang

(10) Patent No.: US 9,640,109 B2
(45) Date of Patent: May 2, 2017

(54) PIXEL DRIVING CIRCUIT, PIXEL DRIVING METHOD, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventor: Shengji Yang, Beijing (CN)

(73) Assignees: BOE TECHNOLOGIES GROUP CO., LTD., Beijing (CN); BEIJING BOE OPTOELECTRONICS TECHOLOGY CO., Beijing (CN)

( * ) Notice: Subject to any disclaimer, the term of this patent is extended or adjusted under 35 U.S.C. 154(b) by 0 days.

(21) Appl. No.: 14/769,346

(22) PCT Filed: Jan. 23, 2015

(86) PCT No.: PCT/CN2015/071406
§ 371 (c)(1),
(2) Date: Aug. 20, 2015

(87) PCT Pub. No.: WO2016/045283
PCT Pub. Date: Mar. 31, 2016

(65) Prior Publication Data

US 2016/0253963 A1 Sep. 1, 2016

(30) Foreign Application Priority Data

Sep. 25, 2014 (CN) ..... 2014 1 0498525

(51) Int. Cl.
*G09G 3/3225* (2016.01)
*G09G 3/3233* (2016.01)
*G09G 3/3291* (2016.01)

(52) U.S. Cl.
CPC ..... *G09G 3/3225* (2013.01); *G09G 3/3233* (2013.01); *G09G 3/3291* (2013.01);
(Continued)

(58) Field of Classification Search
None
See application file for complete search history.

(56) References Cited

U.S. PATENT DOCUMENTS 7,196,682 B2 3/2007 Lo

FOREIGN PATENT DOCUMENTS

CN 103474025 A 12/2013
CN 104036729 A 9/2014
(Continued)

OTHER PUBLICATIONS

First Office Action regarding Chinese application No. 201410498525.2, dated Jan. 28, 2016. Translation provided by Dragon Intellectual Property Law Firm.
(Continued)

*Primary Examiner* — Kenneth B Lee, Jr.
(74) *Attorney, Agent, or Firm* — Harness, Dickey & Pierce, P.L.C.

(57) ABSTRACT

The present disclosure provides a pixel driving circuit, including a first pixel driving unit and a second pixel driving unit. The first pixel driving unit includes a first driving transistor, a first storage capacitor and a first driving control unit. The first driving control unit is configured to apply a jumping voltage onto the data voltage at a first compensation stage, so as to perform jumping compensation on a threshold voltage of the first driving transistor. The second pixel driving unit includes a second driving transistor, a second storage capacitor and a second driving control unit. The second driving control unit is configured to apply a jumping voltage onto the data voltage at a second compensation
(Continued)

stage, so as to perform jumping compensation on a threshold voltage of the second driving transistor and control the second light-emitting element to emit light.

20 Claims, 10 Drawing Sheets

(52) U.S. Cl.
CPC ..... *G09G 2300/0426* (2013.01); *G09G 2300/0465* (2013.01); *G09G 2300/0819* (2013.01); *G09G 2300/0842* (2013.01); *G09G 2300/0861* (2013.01); *G09G 2310/0262* (2013.01); *G09G 2320/043* (2013.01); *G09G 2330/028* (2013.01)

(56) References Cited

FOREIGN PATENT DOCUMENTS

| | | | |
|---|---|---|---|
| CN | 104036731 | A | 9/2014 |
| CN | 104050919 | A | 9/2014 |
| CN | 104078004 | A | 10/2014 |
| CN | 104134426 | A | 11/2014 |
| CN | 104252845 | A | 12/2014 |
| EP | 1857998 | A1 | 11/2007 |
| JP | 2007304598 | A | 11/2007 |

OTHER PUBLICATIONS

Written Opinion of the International Searching Authority for international application No. PCT/CN2015/071406.
Second Office Action regarding Chinese application No. 201410498525.2, dated Sep. 20, 2016. Translation provided by Dragon Intellectual Property Law Firm.

PIXEL DRIVING CIRCUIT, PIXEL DRIVING METHOD, DISPLAY PANEL AND DISPLAY DEVICE

CROSS-REFERENCE TO RELATED APPLICATION

This application is the U.S. national phase of PCT Application No. PCT/CN2015/071406 filed on Jan. 23, 2015, which claims a priority of the Chinese Patent Application No. 201410498525.2 filed on Sep. 25, 2014, the disclosures of which are incorporated in their entirety by reference herein.

TECHNICAL FIELD

The present disclosure relates to the field of display technology, in particular to a pixel driving circuit, a pixel driving method, a display panel and a display device.

BACKGROUND

An active matrix/organic light-emitting diode (AMOLED) display is one of the current hotspots in the research field of flat-panel displays. An organic light-emitting diode (OLED) has such advantages as low power consumption, low production cost, self-luminescence, wide viewing angle and rapid response. As a core technology of the AMOLED display, the design of a pixel driving circuit is significant and important.

For the AMOLED display, a stable current is required so as to control the OLED to emit light. Due to the limitations of the manufacture process and the aging of elements, a threshold voltage (Vth) of a driving transistor for each pixel in the AMOELD display will be drifted, which thus results in a change of the current flowing through the OLED of each pixel along with the threshold voltage. As a result, the display brightness is uneven, and thereby an image display effect will be adversely affected.

As shown in FIG. 1, an existing, basic AMOLED pixel driving circuit merely includes one driving transistor DTFT, one switching transistor T1 and one storage capacitor Cs. When the pixels in one row are to be scanned by a scanning line, a scanning voltage Vscan on the scanning line is a low level, T1 is turned on and a data voltage Vdata is written into the storage capacitor Cs. After the scanning of this row is completed, Vscan changes to be a high level, T1 is turned off, and DTFT is driven by a gate voltage stored in Cs to enable DTFT to generate a current for driving the OLED, thereby to ensure the OLED to emit light continuously within one frame. The current $I_{OLED}$ flowing through the OLED is equal to $K(V_{GS}-V_{th})^2$, where K is a constant, $V_{GS}$ is a gate-source voltage of DTFT, and $V_{th}$ is the threshold voltage of DTFT. Just as mentioned hereinbefore, due to the limitations of the manufacture process and the aging of elements, the threshold voltage $V_{th}$ of the driving transistor DTFT for each pixel will be drifted, which thus results in a change of the current flowing through the OLED of each pixel along with the threshold voltage $V_{th}$. As a result, the image display effect will be adversely affected.

An existing pixel driving circuit having a threshold compensation function may be a 6T1C-based pixel driving circuit, where excessive thin film transistors (TFTs) and lines are used. Though it is able to meet the requirement of threshold compensation, an aperture ratio of the pixel will be reduced correspondingly. In addition, the existing pixel driving circuit is arranged within each pixel unit, so the OLEDs are distributed in a too compact manner.

SUMMARY

An object of the present disclosure is to provide a pixel driving circuit, a pixel driving method, a display panel and a display device, so as to prevent a small aperture ratio of a pixel due to excessive TFTs and data lines used during the threshold compensation, thereby to improve the image quality and pixels per inch (PPI).

In one aspect, the present disclosure provides in one embodiment a pixel driving circuit for driving a first light-emitting element and a second light-emitting element. First ends of the first light-emitting element and the second light-emitting element are configured to receive a first level. The pixel driving circuit includes a first pixel driving unit and a second pixel driving unit.

The first pixel driving unit includes a first driving transistor, a first storage capacitor and a first driving control unit. A first end of the first storage capacitor is connected to a gate electrode of the first driving transistor, and a second end thereof is configured to receive a data voltage through the first driving control unit. The gate electrode of the first driving transistor is connected to a first electrode of the first driving transistor through the first driving control unit, the first electrode thereof is configured to receive a second level through the first driving control unit, and a second electrode thereof is configured to receive the first level through the first driving control unit. The second electrode of the first driving transistor is further connected to a second end of the first light-emitting element. The first driving control unit is configured to charge and discharge the first storage capacitor through the second level, the data voltage and the first level, so as to apply a jumping voltage onto the data voltage at a first compensation stage, thereby to perform jumping compensation on a threshold voltage of the first driving transistor and control the first light-emitting element to emit light.

The second pixel driving unit includes a second driving transistor, a second storage capacitor and a second driving control unit. A first end of the second storage capacitor is connected to a gate electrode of the second driving transistor, and a second end thereof is configured to receive the data voltage through the first driving control unit. The gate electrode of the second driving transistor is connected to a first electrode of the second driving transistor through the second driving control unit, the first electrode thereof is configured to receive the second level through the second driving control unit, and a second electrode thereof is configured to receive the first level through the second driving control unit. The second electrode of the second driving transistor is further connected to a second end of the second light-emitting element. The second driving control unit is configured to charge and discharge the second storage capacitor through the second level, the data voltage and the first level, so as to apply a jumping voltage onto the data voltage at a second compensation stage, thereby to perform jumping compensation on a threshold voltage of the second driving transistor and control the second light-emitting element to emit light.

Alternatively, the first driving control unit is of a structure identical to the second driving control unit.

Alternatively, the first driving control unit includes: a first control transistor, a gate electrode of which is configured to receive a first scanning signal, a, first electrode of which is connected to the first electrode of the first driving transistor, and a second electrode of which is connected to the gate electrode of the first driving transistor; a second control transistor, a gate electrode of which is configured to receive the first scanning signal, a first electrode of which is connected to the second electrode of the first driving transistor, and a second electrode of which is configured to receive the first level; a third control transistor, a gate electrode of which is configured to receive a first driving control signal, a first electrode of which is connected to the second end of the first storage capacitor, and a second electrode of which is configured to receive the data voltage; and a fourth control transistor, a gate electrode of which is configured to receive a second scanning signal, a first electrode of which is configured to receive the second level, and a second electrode of which is connected to the first electrode of the first driving transistor. The second driving control unit includes: a fifth control transistor, a gate electrode of which is configured to receive the first scanning signal, a first electrode of which is connected to the first electrode of the second driving transistor, and a second electrode of which is connected to the gate electrode of the second driving transistor; a sixth control transistor, a gate electrode of which is configured to receive the first scanning signal, a first electrode of which is connected to the second electrode of the second driving transistor, and a second electrode of which is configured to receive the first level; a seventh control transistor, a gate electrode of which is configured to receive a second driving control signal, a first electrode of which is connected to the second end of the second storage capacitor, and a second electrode of which is configured to receive the data voltage; and an eighth control transistor, a gate electrode of which is configured to receive the second scanning signal, a first electrode of which is configured to receive the second level, and a second electrode of which is connected to the first electrode of the second driving transistor.

Alternatively, in the first pixel driving unit, the first driving transistor, the first control transistor, the second control transistor, the third control transistor and the fourth control transistor are all n-type TFTs, and in the second pixel driving unit, the second driving transistor, the fifth control transistor, the sixth control transistor, the seventh control transistor and the eighth control transistor are all n-type TFTs.

Alternatively, the first driving control unit includes: a first control transistor, a gate electrode of which is configured to receive a first scanning signal, a first electrode of which is connected to the first electrode of the first driving transistor, and a second electrode of which is connected to the gate electrode of the first driving transistor; a second control transistor, a gate electrode of which is configured to receive the first scanning signal, a first electrode of which is connected to the second electrode of the first driving transistor, and a second electrode of which is configured to receive the first level; a third control transistor, a gate electrode of which is configured to receive a first driving control signal, a first electrode of which is connected to the second end of the first storage capacitor, and a second electrode of which is configured to receive the data voltage; and a fourth control transistor, a gate electrode of which is configured to receive a second scanning signal, a first electrode of which is configured to receive the second level, and a second electrode of which is connected to the first electrode of the first driving transistor. The second driving control unit includes: a fifth control transistor, a gate electrode of which is configured to receive the first scanning signal, a first electrode of which is connected to the first electrode of the second driving transistor, and a second electrode of which is connected to the gate electrode of the second driving transistor; a sixth control transistor, a gate electrode of which is configured to receive the first scanning signal, a first electrode of which is connected to the second electrode of the second driving transistor, and a second electrode of which is configured to receive the first level; a seventh control transistor, a gate electrode of which is configured to receive the second scanning signal, a first electrode of which is connected to the second end of the second storage capacitor, and a second electrode of which is configured to receive the data voltage; and an eighth control transistor, a gate electrode of which is configured to receive the second scanning signal, a first electrode of which is configured to receive the second level, and a second electrode of which is connected to the first electrode of the second driving transistor.

Alternatively, in the first pixel driving unit, the first driving transistor, the first control transistor, the second control transistor, the third control transistor and the fourth control transistor are all n-type TFTs; in the second pixel driving unit, the second driving transistor, the fifth control transistor, the sixth control transistor and the eighth control transistor are all n-type TFTs, and the seventh control transistor is a p-type TFT.

Alternatively, the first driving control unit includes: a first control transistor, a gate electrode of which is configured to receive a first scanning signal, a first electrode of which is connected to the first electrode of the first driving transistor, and a second electrode of which is connected to the gate electrode of the first driving transistor; a second control transistor, a gate electrode of which is configured to receive the first scanning signal, a first electrode of which is connected to the second electrode of the first driving transistor, and a second electrode of which is configured to receive the first level; a third control transistor, a gate electrode of which is configured to receive a first driving control signal, a first electrode of which is connected to the second end of the first storage capacitor, and a second end of which is configured to receive the data voltage; and a fourth control transistor, a gate electrode of which is configured to receive a second driving control signal, a first electrode of which is configured to receive the second level, and a second electrode of which is connected to the first electrode of the first driving transistor. The second driving control unit includes: a fifth control transistor, a gate electrode of which is configured to receive the first scanning signal, a first electrode of which is connected to the first electrode of the second driving transistor, and a second electrode of which is connected to the gate electrode of the second driving transistor; a sixth control transistor, a gate electrode of which is configured to receive the first scanning signal, a first electrode of which is connected to the second electrode of the second driving transistor, and a second electrode of which is configured to receive the first level; a seventh control transistor, a gate electrode of which is configured to receive the second driving control signal, a first electrode of which is connected to the second end of the second storage capacitor, and a second electrode of which is configured to receive the data voltage; and an eighth control transistor, a gate electrode of which is configured to receive the second driving control signal, a first electrode of which is configured to receive the second level, and a second electrode of which is connected to the first electrode of the second driving transistor.

Alternatively, in the first pixel driving unit, the first driving transistor, the first control transistor, the second control transistor and the third control transistor are all n-type TFTs, and the fourth control transistor is a p-type TFT. In the second pixel driving unit, the second driving transistor, the fifth control transistor, the sixth control transistor and the seventh control transistor are all n-type TFTs, and the eighth control transistor is a p-type TFT.

In another aspect, the present disclosure provides in one embodiment a pixel driving circuit for driving a first light-emitting element and a second light-emitting element. First ends of the first light-emitting element and the second light-emitting element are configured to receive a first level. The pixel driving circuit includes a first pixel driving unit and a second pixel driving unit.

The first pixel driving unit includes a first driving transistor, a first storage capacitor and a first driving control unit. A first end of the first storage capacitor is connected to a gate electrode of the first driving transistor, and a second end thereof is configured to receive a data voltage through the first driving control unit. The gate electrode of the first driving transistor is connected to a first electrode of the first driving transistor through the first driving control unit, the first electrode thereof is connected to a second end of the first light-emitting element through the first driving control unit, and a second electrode thereof is configured to receive a second level through the first driving control unit. The first driving control unit is configured to reset and charge the first storage capacitor through the second level and the data voltage, so as to apply a jumping voltage onto the data voltage at a first compensation stage, thereby to perform jumping compensation on a threshold voltage of the first driving transistor and control the first driving transistor to drive the first light-emitting element to emit light.

The second pixel driving unit includes a second driving transistor, a second storage capacitor and a second driving control unit. A first end of the second storage capacitor is connected to a gate electrode of the second driving transistor, and a second end thereof is configured to receive the data voltage through the second driving control unit. The gate electrode of the second driving transistor is connected to a first electrode of the second driving transistor through the second driving control unit, the first electrode thereof is connected to a second end of the second light-emitting element through the second driving control unit, and a second electrode thereof is configured to receive the second level through the second driving control unit. The second driving control unit is configured to reset and charge the second storage capacitor through the second level and the data voltage, so as to apply a jumping voltage onto the data voltage at a second compensation stage, thereby to perform jumping compensation on a threshold voltage of the second driving transistor and control the second driving transistor to drive the second light-emitting element to emit light.

Alternatively, the first driving control unit is of a structure identical to the second driving control unit.

Alternatively, the first driving control unit includes: a first control transistor, a gate electrode of which is configured to receive a first driving control signal, a first electrode of which is connected to the first electrode of the first driving transistor, and a second electrode of which is connected to the gate electrode of the first driving transistor; a second control transistor, a gate electrode of which is configured to receive the first driving control signal, a first electrode of which is configured to receive the data voltage, and a second electrode of which is connected to the second end of the first storage capacitor; a third control transistor, a gate electrode of which is configured to receive a first scanning signal, a first electrode of which is connected to the second electrode of the first driving transistor, and a second electrode of which is configured to receive the second level; and a fourth control transistor, a gate electrode of which is configured to receive a second scanning signal, a first electrode of which is connected to the second end of the first light-emitting element, and a second electrode of which is connected to the first electrode of the first driving transistor. The second driving control unit includes: a fifth control transistor, a gate electrode of which is configured to receive a second driving control signal, a first electrode of which is connected to the first electrode of the second driving transistor, and a second electrode of which is connected to the gate electrode of the second driving transistor; a sixth control transistor, a gate electrode of which is configured to receive the second driving control signal, a first electrode of which is configured to receive the data voltage, and a second electrode of which is connected to the second end of the second storage capacitor; a seventh control transistor, a gate electrode of which is configured to receive the first scanning signal, a first electrode of which is connected to the second electrode of the second driving transistor, and a second electrode of which is configured to receive the second level; and an eighth control transistor, a gate electrode of which is configured to receive the second scanning signal, a first electrode of which is connected to the second end of the second light-emitting element, and a second electrode of which is connected to the first electrode of the second driving transistor.

Alternatively, in the first pixel driving unit, the first driving transistor, the first control transistor, the second control transistor, the third control transistor and the fourth control transistor are all p-type TFTs, and in the second pixel driving unit, the second driving transistor, the fifth control transistor, the sixth control transistor, the seventh control transistor and the eighth control transistor are all p-type TFTs.

In yet another aspect, the present disclosure provides in one embodiment a pixel driving method for driving the above-mentioned pixel driving circuit, including steps of: at a charging stage within one time period, controlling by a first driving control unit a first end of a first storage capacitor to be charged to a second level, and controlling by a second driving control unit a first end of a second storage capacitor to be charged to a second level; at a discharging stage within the time period, controlling by the first driving control unit the first end of the first storage capacitor to be discharged to a threshold voltage of a first driving transistor and controlling a second end of the first storage capacitor to receive a data voltage, and controlling by the second driving control unit the first end of the second storage capacitor to be discharged to a threshold voltage of a second driving transistor and controlling a second end of the second storage capacitor to receive the data voltage, the data voltage being $V0$ at the discharging stage; at a first compensation stage within the time period, controlling by the first driving control unit the second end of the first storage capacitor to receive the data voltage, and controlling the first end of the first storage capacitor to be in a floating state, thereby compensating for a threshold voltage of the first driving transistor through a gate-source voltage of the first driving transistor, the data voltage being jumped to $V0+\Delta V1$ at the first compensation stage; at a second compensation stage within the time period, controlling by the second driving control unit the second end of the second storage capacitor to receive the data voltage and controlling the first end of the second storage capacitor to be in a floating state, thereby compensating for a threshold voltage of the second driving transistor through a gate-source voltage of the second driving transistor, the data voltage being jumped to $V0+\Delta V2$ at the second compensation stage; and at a light-emitting stage within the time period, controlling by the first driving control unit the first driving transistor to drive a first light-emitting element to emit light, and controlling by the second driving control unit the second driving transistor to drive a second light-emitting element to emit light.

Alternatively, when the driving transistors included in the pixel driving circuit are all n-type TFTs, V0, ΔV1 and ΔV2 are greater than 0, and ΔV2 is greater than ΔV1.

In still yet another aspect, the present disclosure provides in one embodiment a pixel driving method for driving the above-mentioned pixel driving circuit, including steps of: at a resetting and charging stage within one time period, controlling by a first driving control unit a first end of a first storage capacitor to be charged to a difference between a second level and a threshold voltage of a first driving transistor and controlling a second end of the first storage capacitor to receive a data voltage, and controlling by a second driving control unit a first end of a second storage capacitor to be charged to a difference between the second level and a threshold voltage of a second driving transistor and controlling a second end of the second storage capacitor to receive the data voltage, the data voltage being ΔV1 at the resetting and charging stage; at a first compensation stage within the time period, controlling by the first driving control unit the first end of the first storage capacitor to be in a floating state, thereby compensating for the threshold voltage of the first driving transistor through a gate-source voltage of the first driving transistor, the data voltage being jumped to ΔV2 at the first compensation stage; at a second compensation stage within the time period, controlling by the second driving control unit the first end of the second storage capacitor to be in a floating state, thereby compensating for the threshold voltage of the second driving transistor through a gate-source voltage of the second driving transistor, the data voltage being jumped to ΔV3 at the second compensation stage; and at a light-emitting stage within the time period, controlling by the first driving control unit the first driving transistor to drive a first light-emitting element to emit light, and controlling by the second driving control unit the second driving transistor to drive a second light-emitting element to emit light.

Alternatively, when the driving transistors included in the pixel driving circuit are all p-type TFTs, ΔV1, ΔV2 and ΔV3 are greater than 0, ΔV3 is greater than ΔV2, and ΔV2 is greater than ΔV1.

In still yet another aspect, the present disclosure provides in one embodiment a display panel including the above-mentioned pixel driving circuit.

In still yet another aspect, the present disclosure provides in one embodiment a display device including the above-mentioned display panel.

According to the pixel driving circuit in the embodiments of the present disclosure, two adjacent pixel driving units having a threshold voltage compensation function in the related art are combined so as to share a single data line, thereby it is able to control two pixel units to perform jumping compensation on the threshold voltage of the driving transistor at the corresponding compensation stage through the pixel driving circuit having the threshold voltage compensation function, and to reduce the number of the TFTs desired for the threshold voltage compensation as well as the number of the data lines. As a result, it is able to remarkably increase an aperture ratio of the pixel unit and reduce the production cost, thereby to improve the image quality and the PPI.

DETAILED DESCRIPTION

Figure 1:
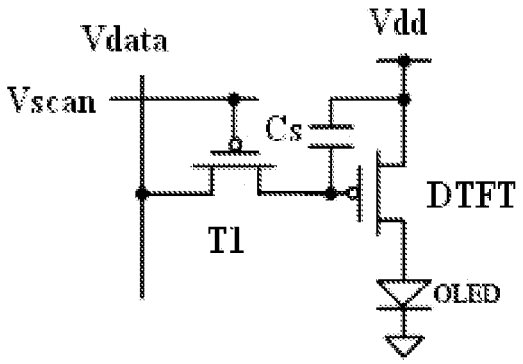
FIG. 1 is a circuit diagram of an existing, basic AMOLED pixel driving circuit.

The present disclosure will be described hereinafter in a clear and complete manner in conjunction with the drawings and embodiments. Obviously, the following embodiments are merely a part of, rather than all of, the embodiments of the present disclosure, and based on these embodiments, a person skilled in the art, without any creative effort, may obtain the other embodiments, which also fall within the scope of the present disclosure.

All transistors adopted in the embodiments of the present disclosure may be thin film transistors (TFTs), field effect transistors (FETs), or any other elements having the same characteristics. In the embodiments of the present disclosure, in order to differentiate two electrodes, other than a gate electrode, from each other, a first electrode may be a source/drain electrode, and a second electrode may be a drain/source electrode. In addition, depending on its characteristics, the transistor may be an n-type or a p-type transistor, and a driver circuit in the embodiments of the present disclosure may include n-type or p-type transistors.

The present disclosure provides in a first embodiment a pixel driving circuit for driving a first light-emitting element and a second light-emitting element. First ends of the first light-emitting element and the second light-emitting element are configured to receive a first level. The pixel driving circuit includes a first pixel driving unit and a second pixel driving unit.

The first pixel driving unit includes a first driving transistor, a first storage capacitor and a first driving control unit. A first end of the first storage capacitor is connected to a gate electrode of the first driving transistor, and a second end thereof is configured to receive a data voltage through the first driving control unit. The gate electrode of the first driving transistor is connected to a first electrode of the first driving transistor through the first driving control unit, the first electrode thereof is configured to receive a second level through the first driving control unit, and a second electrode thereof is configured to receive the first level through the first driving control unit. The second electrode of the first driving transistor is further connected to a second end of the first light-emitting element. The first driving control unit is configured to charge and discharge the first storage capacitor through the second level, the data voltage and the first level, so as to apply a jumping voltage onto the data voltage at a first compensation stage, thereby to perform jumping compensation on a threshold voltage of the first driving transistor and control the first light-emitting element to emit light.

The second pixel driving unit includes a second driving transistor, a second storage capacitor and a second driving control unit. A first end of the second storage capacitor is connected to a gate electrode of the second driving transistor, and a second end thereof is configured to receive the data voltage through the first driving control unit. The gate electrode of the second driving transistor is connected to a first electrode of the second driving transistor through the second driving control unit, the first electrode thereof is configured to receive the second level through the second driving control unit, and a second electrode thereof is configured to receive the first level through the second driving control unit. The second electrode of the second driving transistor is further connected to a second end of the second light-emitting element. The second driving control unit is configured to charge and discharge the second storage capacitor through the second level, the data voltage and the first level, so as to apply a jumping voltage onto the data voltage at a second compensation stage, thereby to perform jumping compensation on a threshold voltage of the second driving transistor and control the second light-emitting element to emit light.

According to the pixel driving circuit in the embodiment of the present disclosure, two adjacent pixel driving units having a threshold voltage compensation function in the related art are combined so as to share a single data line, thereby it is able to control two pixel units to perform jumping compensation on the threshold voltage of the driving transistor at the corresponding compensation stage through one pixel driving circuit having the threshold voltage compensation function, and to reduce the number of the TFTs desired for the threshold voltage compensation as well as the number of the data lines. As a result, it is able to remarkably increase an aperture ratio of the pixel unit and reduce the production cost, thereby to improve the image quality and the PPI.

Alternatively, the light-emitting element may be an organic light-emitting diode (OLED).

Figure 2:
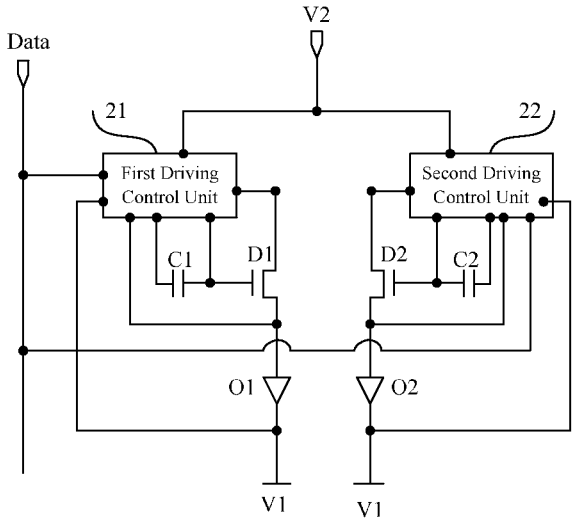
FIG. 2 is a block diagram of a pixel driving circuit according to a second embodiment of the present disclosure.

As shown in FIG. 2, the present disclosure provides in a second embodiment a pixel driving circuit for driving a first OLED O1 and a second OLED O2. Cathodes of the first OLED O1 and the second OLED O2 are both configured to receive a first level V1. The pixel driving circuit includes a first pixel driving unit for controlling the first OLED O1 and a second pixel driving unit for controlling the second OLED O2.

The first pixel driving unit includes a first driving transistor D1, a first storage capacitor C1 and a first driving control unit 21. A first end of the first storage capacitor C1 is connected to a gate electrode of the first driving transistor D1, and a second end thereof is configured to receive a data voltage on a data line Data through the first driving control unit 21. The gate electrode of the first driving transistor D1 is connected to a first electrode of the first driving transistor D1 through the first driving control unit 21, the first electrode thereof is configured to receive a second level V2 through the first driving control unit 21, and a second electrode thereof is configured to receive the first level V1 through the first driving control unit 21. The second electrode of the first driving transistor D1 is further connected to an anode of the first OLED O1. The first driving control unit 21 is configured to charge and discharge the first storage capacitor C1 through the second level V2, the data voltage on the data line Data and the first level V1, so as to control the first driving transistor D1 to drive the first OLED O1 to emit light after compensating for a threshold voltage of the first driving transistor D1 through a gate-source voltage of the first driving transistor D1 at a first compensation stage.

The second pixel driving unit includes a second driving transistor D2, a second storage capacitor C2 and a second driving control unit 22. A first end of the second storage capacitor C2 is connected to a gate electrode of the second driving transistor D2, and a second end thereof is configured to receive the data voltage on the data line Data through the second driving control unit 22. The gate electrode of the second driving transistor D2 is connected to a first electrode of the second driving transistor D2 through the second driving control unit 22, the first electrode thereof is configured to receive the second level V2 through the second driving control unit 22, and a second electrode thereof is configured to receive the first level V1 through the second driving control unit 22. The second electrode of the second driving transistor D2 is further connected to an anode of the second OLED O2. The second driving control unit 22 is configured to charge and discharge the second storage capacitor C2 through the second level V2, the data voltage on the data lien Data and the first level V1, so as to control the second driving transistor D2 to drive the second OLED O2 to emit light after compensating for a threshold voltage of the second driving transistor D2 through a gate-source voltage of the second driving transistor D2 at a second compensation stage.

In the pixel driving circuit as shown in FIG. 2, D1 and D2 are both n-type TFTs, and at this time, the first level V1 is a low level, and the second level V2 is a high level.

In one embodiment, the first driving control unit is of a structure identical to the second driving control unit.

To be specific, the first driving control unit includes: a first control transistor, a gate electrode of which is configured to receive a first scanning signal, a, first electrode of which is connected to the first electrode of the first driving transistor, and a second electrode of which is connected to the gate electrode of the first driving transistor; a second control transistor, a gate electrode of which is configured to receive the first scanning signal, a first electrode of which is connected to the second electrode of the first driving transistor, and a second electrode of which is configured to receive the first level; a third control transistor, a gate electrode of which is configured to receive a first driving control signal, a first electrode of which is connected to the second end of the first storage capacitor, and a second electrode of which is configured to receive the data voltage; and a fourth control transistor, a gate electrode of which is configured to receive a second scanning signal, a first electrode of which is configured to receive the second level, and a second electrode of which is connected to the first electrode of the first driving transistor.

The second driving control unit includes: a fifth control transistor, a gate electrode of which is configured to receive the first scanning signal, a first electrode of which is connected to the first electrode of the second driving transistor, and a second electrode of which is connected to the gate electrode of the second driving transistor; a sixth control transistor, a gate electrode of which is configured to receive the first scanning signal, a first electrode of which is connected to the second electrode of the second driving transistor, and a second electrode of which is configured to receive the first level; a seventh control transistor, a gate electrode of which is configured to receive a second driving control signal, a first electrode of which is connected to the second end of the second storage capacitor, and a second electrode of which is configured to receive the data voltage; and an eighth control transistor, a gate electrode of which is configured to receive the second scanning signal, a first electrode of which is configured to receive the second level, and a second electrode of which is connected to the first electrode of the second driving transistor.

To be specific, in the first pixel driving unit, the first driving transistor, the first control transistor, the second control transistor, the third control transistor and the fourth control transistor are all n-type TFTs, and in the second pixel driving unit, the second driving transistor, the fifth control transistor, the sixth control transistor, the seventh control transistor and the eighth control transistor are all n-type TFTs.

In another embodiment, the first driving control unit may include: a first control transistor, a gate electrode of which is configured to receive a first scanning signal, a first electrode of which is connected to the first electrode of the first driving transistor, and a second electrode of which is connected to the gate electrode of the first driving transistor; a second control transistor, a gate electrode of which is configured to receive the first scanning signal, a first electrode of which is connected to the second electrode of the first driving transistor, and a second electrode of which is configured to receive the first level; a third control transistor, a gate electrode of which is configured to receive a first driving control signal, a first electrode of which is connected to the second end of the first storage capacitor, and a second electrode of which is configured to receive the data voltage; and a fourth control transistor, a gate electrode of which is configured to receive a second scanning signal, a first electrode of which is configured to receive the second level, and a second electrode of which is connected to the first electrode of the first driving transistor.

The second driving control unit may include: a fifth control transistor, a gate electrode of which is configured to receive the first scanning signal, a first electrode of which is connected to the first electrode of the second driving transistor, and a second electrode of which is connected to the gate electrode of the second driving transistor; a sixth control transistor, a gate electrode of which is configured to receive the first scanning signal, a first electrode of which is connected to the second electrode of the second driving transistor, and a second electrode of which is configured to receive the first level; a seventh control transistor, a gate electrode of which is configured to receive the second scanning signal, a first electrode of which is connected to the second end of the second storage capacitor, and a second electrode of which is configured to receive the data voltage; and an eighth control transistor, a gate electrode of which is configured to receive the second scanning signal, a first electrode of which is configured to receive the second level, and a second electrode of which is connected to the first electrode of the second driving transistor.

To be specific, in the first pixel driving unit, the first driving transistor, the first control transistor, the second control transistor, the third control transistor and the fourth control transistor are all n-type TFTs; in the second pixel driving unit, the second driving transistor, the fifth control transistor, the sixth control transistor and the eighth control transistor are all n-type TFTs, and the seventh control transistor is a p-type TFT.

Figure 3A:
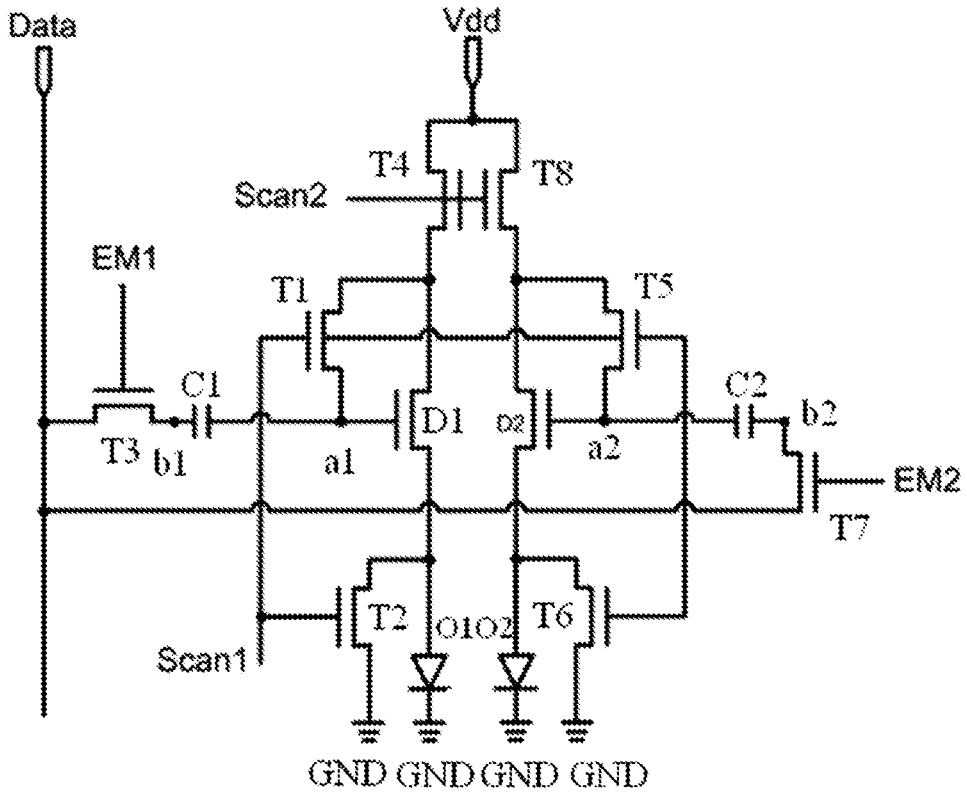
FIG. 3A is a circuit diagram of a pixel driving circuit according to a third embodiment of the present disclosure.

As shown in FIG. 3A, the present disclosure provides in a third embodiment a pixel driving circuit for driving a first OLED O1 and a second OLED O2. Cathodes of the first OLED O1 and the second OLED O2 are both connected to the ground GND. The pixel driving circuit includes a first pixel driving unit for controlling the first OLED O1 and a second pixel driving unit for controlling the second OLED O2.

The first pixel driving unit includes a first driving transistor D1, a first storage capacitor C1 and a first driving control unit. A gate electrode of the first driving transistor D1 is connected to a first end of the first storage capacitor C1.

The first driving control unit includes: a first control transistor T1, a gate electrode of which is configured to receive a first scanning signal Scan1, a first electrode of which is connected to a first electrode of the first driving transistor D1, and a second electrode of which is connected to the gate electrode of the first driving transistor D1; a second control transistor T2, a gate electrode of which is configured to receive the first scanning signal Scan1, a first electrode of which is connected to a second electrode of the first driving transistor D1, and a second electrode of which is connected to the ground GND; a third control transistor T3, a gate electrode of which is configured to receive a first driving control signal EM1, a first electrode of which is connected to a second end of the first storage capacitor C1, and a second electrode of which is configured to receive a data voltage on a data line Data; and a fourth control transistor T4, a gate electrode of which is configured to receive a second scanning signal Scan2, a first electrode of which is configured to receive a high level Vdd, and a second electrode of which is connected to the first electrode of the first driving transistor D1.

The second electrode of the first driving transistor D1 is connected to an anode of the first OLED O1. The cathode of the first OLED O1 is connected to the ground GND.

The second pixel driving unit includes a second driving transistor D2, a second storage capacitor C2 and a second driving control unit. A gate electrode of the second driving transistor D2 is connected to a first end of the second storage capacitor C2.

The second driving control unit includes: a fifth control transistor T5, a gate electrode of which is configured to receive the first scanning signal Scan1, a first electrode of which is connected to a first electrode of the second driving transistor D2, and a second electrode of which is connected to the gate electrode of the second driving transistor D2; a sixth control transistor T6, a gate electrode of which is configured to receive the first scanning signal Scan1, a first electrode of which is connected to a second electrode of the second driving transistor D2, and a second electrode of which is connected to the ground GND; a seventh control transistor T7, a gate electrode of which is configured to receive a second driving control signal EM2, a first electrode of which is connected to a second end of the second storage capacitor C2, and a second electrode of which is configured to receive the data voltage on the data line Data; and an eighth control transistor T8, a gate electrode of which is configured to receive the second scanning signal Scan2, a first electrode of which is configured to receive the high level Vdd, and a second electrode of which is connected to the first electrode of the second driving transistor D2.

The second electrode of the second driving transistor D2 is connected to an anode of the second OLED O2. The cathode of the second OLED O2 is connected to the ground GND.

In FIG. 3A, a1 represents a node connected to the first end of C1, a2 represents a node connected to the first end of C2, b1 represents a node connected to the second end of C1, and b2 represents a node connected to the second end of C2.

In the pixel driving circuit as shown in FIG. 3A, D1, D2, T1, T2, T3, T4, T5, T6, T7 and T8 are all n-type TFTs, so it is able to manufacture them by an identical process, thereby to improve the yield thereof.

Figure 3B:
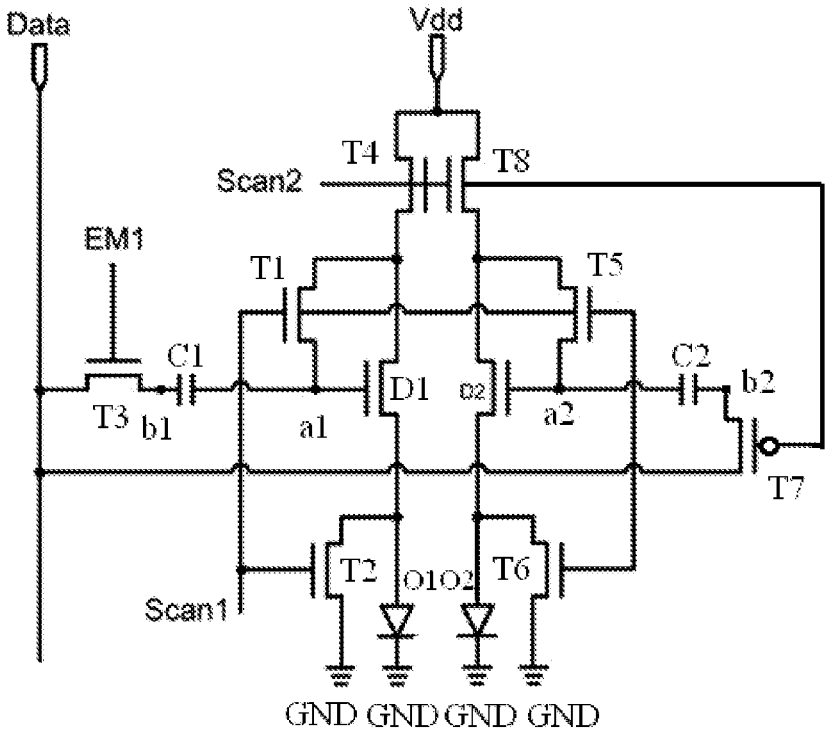
FIG. 3B is a circuit diagram of a pixel driving circuit according to a fourth embodiment of the present disclosure.
Figure 3C:
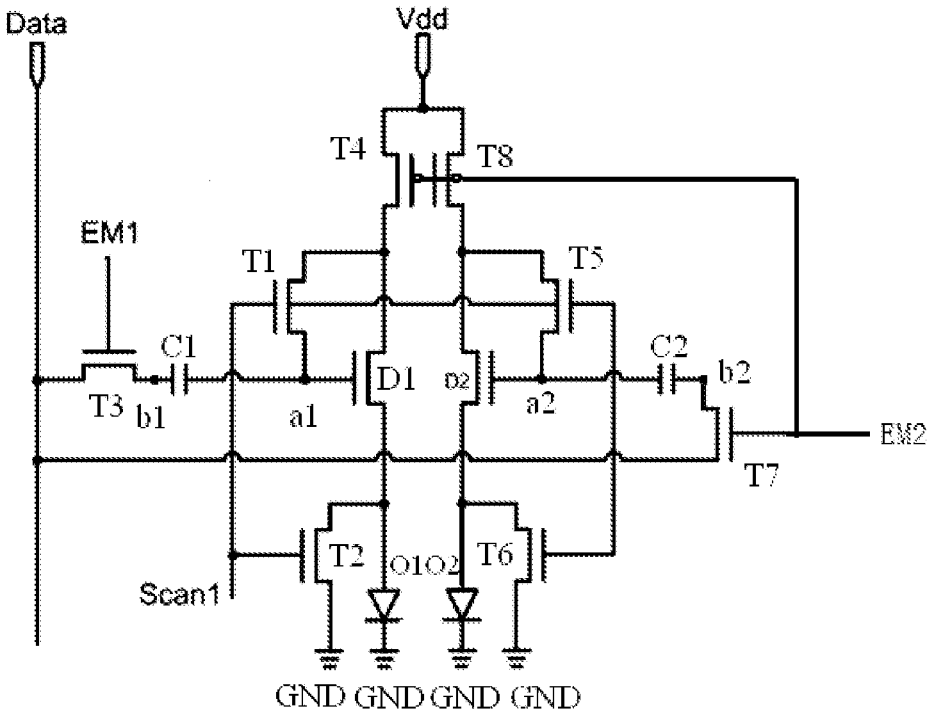
FIG. 3C is a circuit diagram of a pixel driving circuit according to a fifth embodiment of the present disclosure.
Figure 4:
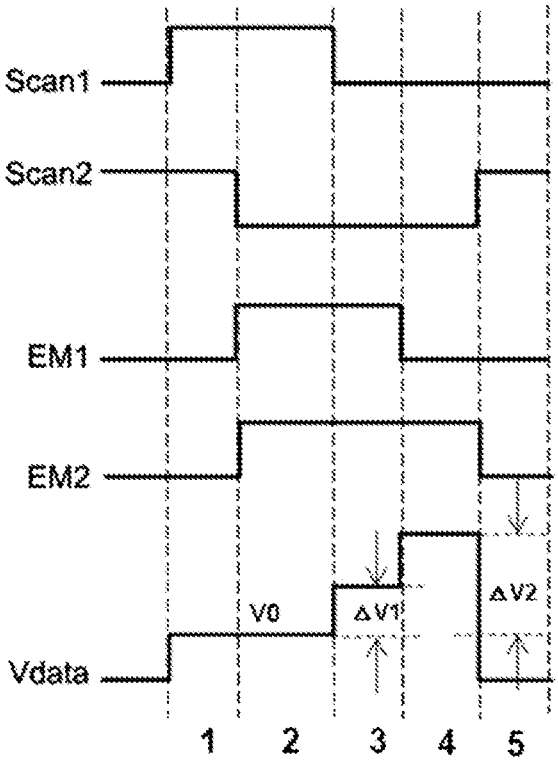
FIG. 4 is a time sequence diagram of the pixel driving circuit according to the third embodiment of the present disclosure.

In addition, as shown in FIG. 4, an oscillogram of Scan2 is a symmetric reversal of an oscillogram of EM2, so it is also able to reduce the number of control signal lines by changing types of the transistors which are configured to receive Scan2 and EM2. For example, as shown in FIG. 3B, in the pixel driving circuit according to a fourth embodiment of the present disclosure, T7 that should have been configured to receive EM2 in FIG. 3A is changed to a p-type TFT, and the gate electrode of T7 is configured to receive the second scanning signal Scan2, so that it is able to reduce the number of the control signals while achieving the purpose of the present disclosure. Alternatively, as shown in FIG. 3C, in the pixel driving circuit according to a fifth embodiment of the present disclosure, the gate electrodes of T4 and T8, which should have been configured to receive Scan2 in FIG. 3A, are configured to receive EM2, and T4 and T8 are changed to p-type TFTs, so that it is also able to reduce the number of the control signals while achieving the purpose of the present disclosure.

An operating procedure of the pixel driving circuit in FIG. 3A will be described hereinafter.

Figure 5A:
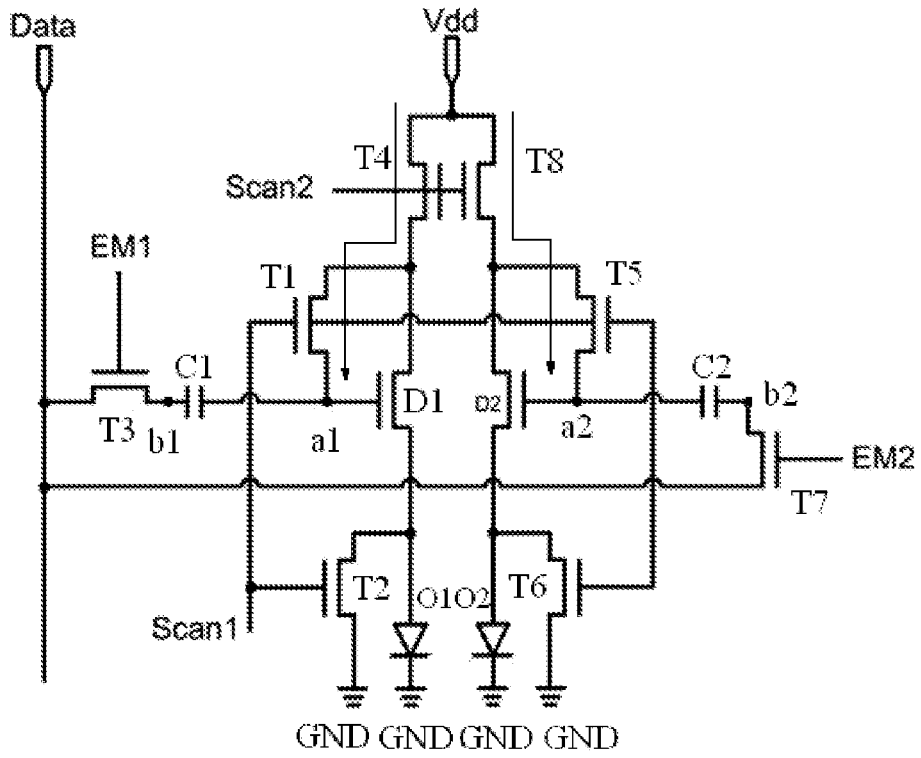
FIG. 5A is a view showing an operating state of the pixel driving circuit at a first stage according to the third embodiment of the present disclosure.

At a first stage, i.e., a charging stage, as shown in FIG. 4, Scan1 and Scan2 are each of a high level, EM1 and EM2 are each of a low level, and the data voltage Vdata on the data line is V0. As shown in FIG. 5A, C1 is charged by Vdd through T4 and T1, so that a1 is at a potential of Vdd and T3 is turned off. C2 is charged by Vdd through T8 and T5, so a2 is at a potential of Vdd and T7 is turned off.

Figure 5B:
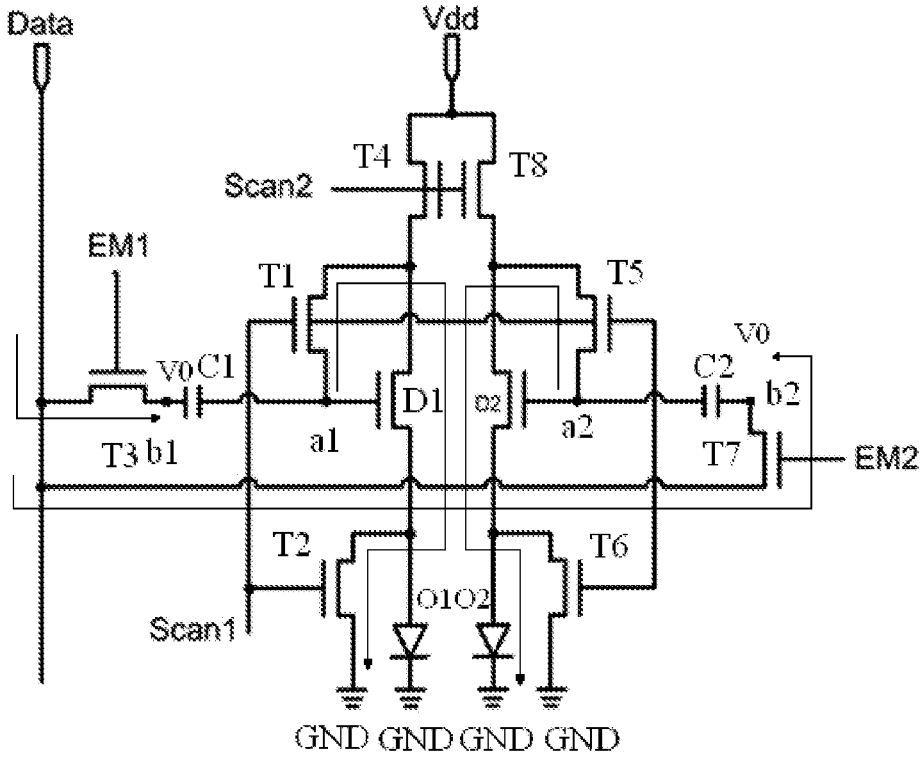
FIG. 5B is a view showing an operating state of the pixel driving circuit at a second stage according to the third embodiment of the present disclosure.

At a second stage, i.e., a discharging stage, as shown in FIG. 4, Scan1, EM1 and EM2 are each of a high level, Scan2 is of a low level, and Vdata is V0. As shown in FIG. 5B, T1, T2 and T3 are all turned on, and T4 is turned off, so C1 is discharged toward the ground through T1, D1 and T2 until a1 is at a potential of a threshold voltage Vth1 of D1. B1 is configured to receive Vdata, so b1 is at a potential of V0. T5, T6 and T7 are turned on, and T8 is turned off, so C2 is discharged toward the ground through T5, D2 and T6 until a2 is at a potential of a threshold voltage Vth2 of D2. B2 is configured to receive Vdata, so b2 is at a potential of V0.

Figure 5C:
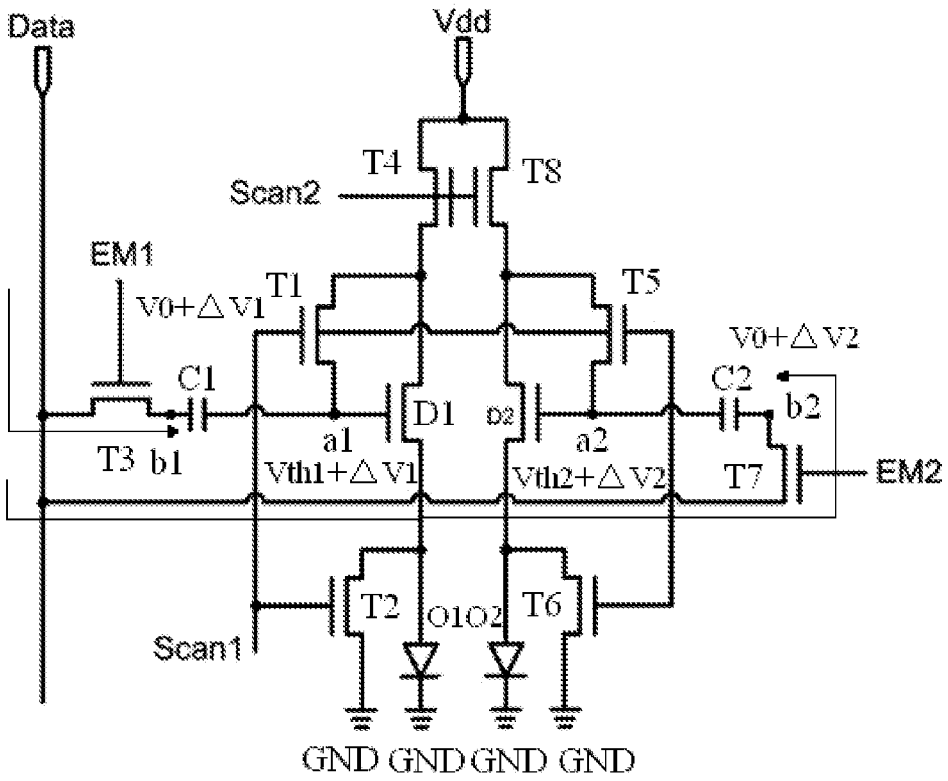
FIG. 5C is a view showing an operating state of the pixel driving circuit at a third stage according to the third embodiment of the present disclosure.

At a third stage, i.e., a first compensation stage, Scan1 and Scan2 are each of a low level, EM1 and EM2 are each of a high level, and Vdata is jumped to V0+ΔV1. As shown in FIG. 5C, the potential at b1 is jumped from V0 at the second stage to V0+ΔV1 at the third stage. At this time, the first end of C1 is in a floating state, so a potential Va1 at a1 and a potential Vb1 at b1 are jumped equally (i.e., an original voltage difference Vth1−V0 is maintained). At this time, a1 is maintained at a potential of ΔV1+Vth1. The potential of b2 is jumped from V0 at the second stage to V0+ΔV1 at the third stage. At this time, the first end of C2 is in a floating state, so a potential Va2 at a2 and a potential Vb2 at b2 are jumped equally (i.e., an original voltage difference Vth2−V0 is maintained). At this time, a2 is maintained at a potential of ΔV1+Vth2.

Figure 5D:
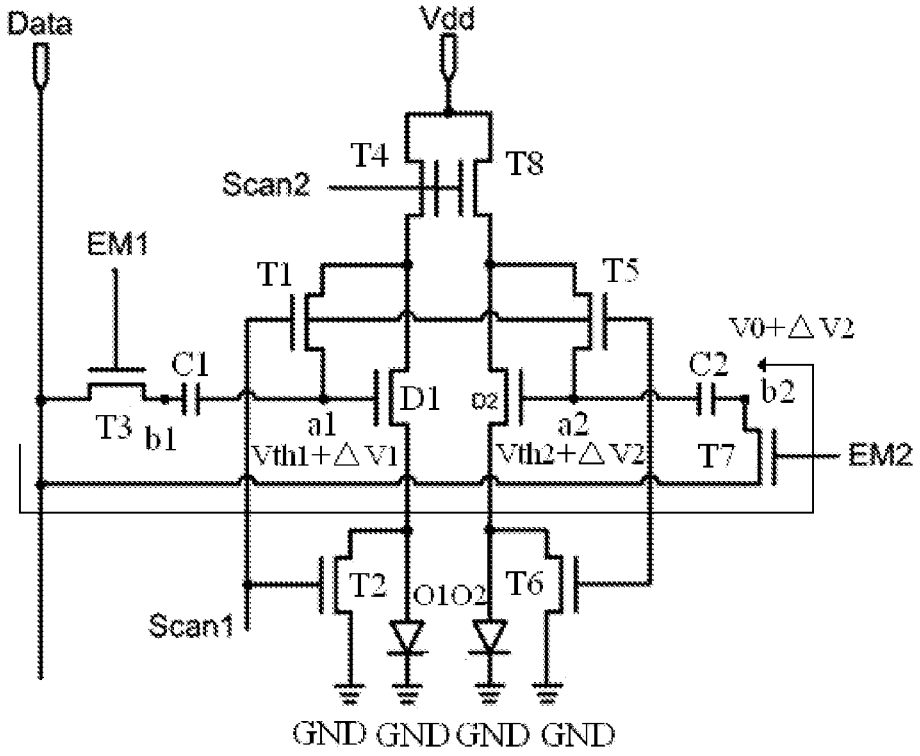
FIG. 5D is a view showing an operating state of the pixel driving circuit at a fourth stage according to the third embodiment of the present disclosure.

At a fourth stage, i.e., a second compensation stage, as shown in FIG. 4, Scan1, Scan2 and EM1 are each of a low level, EM2 is of a high level, and Vdata is jumped to V0+ΔV2. As shown in FIG. 5D, the potential at b2 is jumped from V0+ΔV1 at the third stage to V0+ΔV2 at the fourth stage. The first end of C2 is in the floating state, so the potential Va2 at a2 and the potential Vb2 at b2 are jumped equally (i.e., an original voltage difference Vth2−V0 is maintained). At this time, a2 is maintained at a potential of ΔV2+Vth2.

Figure 5E:
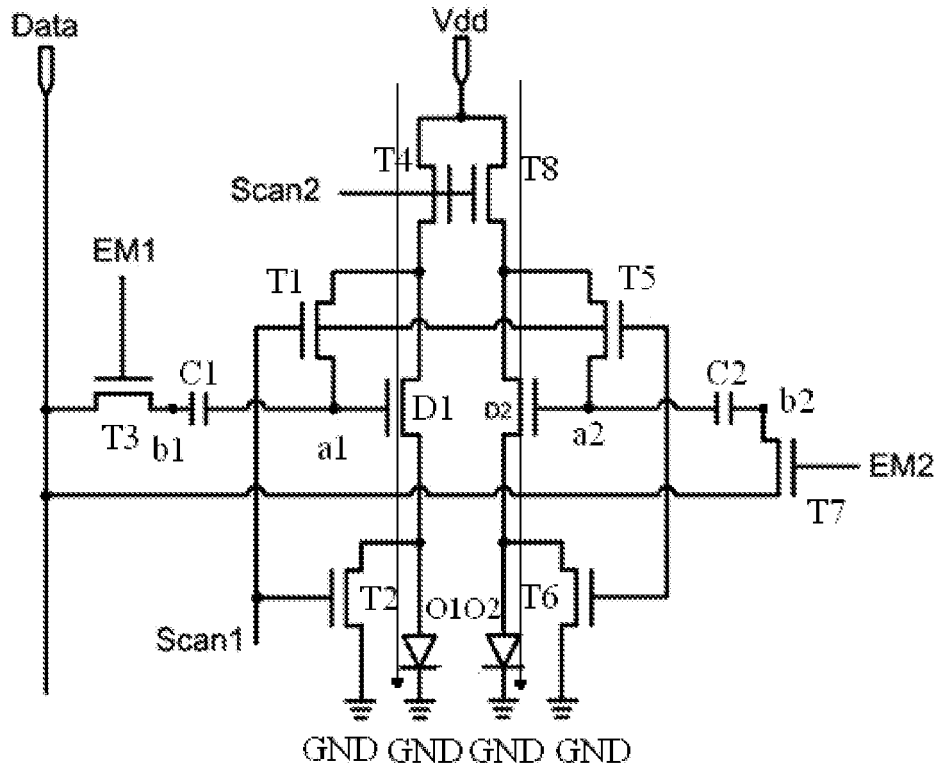
FIG. 5E is a view showing an operating state of the pixel driving circuit at a fifth stage according to the third embodiment of the present disclosure.

At a fifth stage, i.e., a light-emitting stage, as shown in FIG. 4, Scan1, EM1 and EM2 are ach of a low level, and Scan2 is of a high level. As shown in FIG. 5E, the OLED emits light after two voltage compensation stages and two jumping procedures. To be specific, T4 is turned on, the first electrode of D1 is configured to receive the high level Vdd through T4, T2 is turned off, and D1 drives the first OLED O1 to emit light. For a current flowing through O1. $I_{OLED1}=K(Vgs1-Vth1)^2=K[\Delta V1+Vth1-Voled1-Vth1]^2=K(\Delta V1-Voled1)^2$, where Vgs1 represents a gate-source voltage of D1, Voled1 represents a potential at the anode of O1, and K is a constant. Identically, a current flowing through O2 is equal to $K(\Delta V2-Voled2)^2$, where Voled2 represents a potential at the anode of O2.

According to the pixel driving circuit in the embodiments of the present disclosure, the jumping voltage compensation is performed sequentially on a first pixel unit including the first OLED and a second pixel unit including the second OLED, and a jumping signal is applied onto Vdata, i.e., signal superposition and jumping are performed at different time domains, so as to achieve the pixel compensation. As a result, it is able to prevent the occurrence of uneven threshold voltages of the driving TFTs for the two pixel units due to limitations of the manufacture process and a long-term operation, and prevent the currents flowing through the OLEDS included in the two pixel units from being adversely affected by the threshold voltages of the driving transistors, thereby to ensure the even image display. In addition, no current flows through the OLED at the charging stage, the discharging stage, the first compensation stage and the second compensation stage, so it is able to prolong a service life of the OLED.

The present disclosure further provides in one embodiment a pixel driving method for driving the pixel driving circuit according to the first, second, third, fourth or fifth embodiment of the present disclosure, which includes steps of:

at the charging stage within one time period, controlling by the first driving control unit the first end of the first storage capacitor to be charged to the second level, and controlling by the second driving control unit the first end of the second storage capacitor to be charged to the second level;

at the discharging stage within the time period, controlling by the first driving control unit the first end of the first storage capacitor to be discharged to the threshold voltage of the first driving transistor and controlling the second end of the first storage capacitor to receive the data voltage, and controlling by the second driving control unit the first end of the second storage capacitor to be discharged to the threshold voltage of the second driving transistor and controlling the second end of the second storage capacitor to receive the data voltage, the data voltage being V0 at the discharging stage;

at the first compensation stage within the time period, controlling by the first driving control unit the second end of the first storage capacitor to receive the data voltage, and controlling the first end of the first storage capacitor to be in the floating state, thereby compensating for the threshold voltage of the first driving transistor through the gate-source voltage of the first driving transistor, the data voltage being jumped to V0+ΔV1 at the first compensation stage;

at the second compensation stage within the time period, controlling by the second driving control unit the second end of the second storage capacitor to receive the data voltage and controlling the first end of the second storage capacitor to be in the floating state, thereby compensating for the threshold voltage of the second driving transistor through the gate-source voltage of the second driving transistor, the data voltage being jumped to V0+ΔV2 at the second compensation stage; and at the light-emitting stage within the time period, controlling by the first driving control unit the first driving transistor to drive the first light-emitting element to emit light, and controlling by the second driving control unit the second driving transistor to drive the second light-emitting element to emit light.

Alternatively, when the driving transistors included in the pixel driving circuit are all n-type TFTs, V0, ΔV1 and ΔV2 are greater than 0, and ΔV2 is greater than ΔV1.

The present disclosure provides in a sixth embodiment a pixel driving circuit for driving a first light-emitting element and a second light-emitting element. First ends of the first light-emitting element and the second light-emitting element are configured to receive a first level. The pixel driving circuit includes a first pixel driving unit and a second pixel driving unit.

The first pixel driving unit includes a first driving transistor, a first storage capacitor and a first driving control unit. A first end of the first storage capacitor is connected to a gate electrode of the first driving transistor, and a second end thereof is configured to receive a data voltage through the first driving control unit. The gate electrode of the first driving transistor is connected to a first electrode of the first driving transistor through the first driving control unit, the first electrode thereof is connected to a second end of the first light-emitting element through the first driving control unit, and a second electrode thereof is configured to receive a second level through the first driving control unit. The first driving control unit is configured to reset and charge the first storage capacitor through the second level and the data voltage, so as to apply a jumping voltage onto the data voltage at a first compensation stage, thereby to perform jumping compensation on a threshold voltage of the first driving transistor and control the first driving transistor to drive the first light-emitting element to emit light.

The second pixel driving unit includes a second driving transistor, a second storage capacitor and a second driving control unit. A first end of the second storage capacitor is connected to a gate electrode of the second driving transistor, and a second end thereof is configured to receive the data voltage through the second driving control unit. The gate electrode of the second driving transistor is connected to a first electrode of the second driving transistor through the second driving control unit, the first electrode thereof is connected to a second end of the second light-emitting element through the second driving control unit, and a second electrode thereof is configured to receive the second level through the second driving control unit. The second driving control unit is configured to reset and charge the second storage capacitor through the second level and the data voltage, so as to apply a jumping voltage onto the data voltage at a second compensation stage, thereby to perform jumping compensation on a threshold voltage of the second driving transistor and control the second driving transistor to drive the second light-emitting element to emit light.

According to the pixel driving circuit in the embodiment of the present disclosure, two adjacent pixel driving units having a threshold voltage compensation function in the related art are combined so as to share a single data line, thereby it is able to control two pixel units to perform jumping compensation on the threshold voltage of the driving transistor at the corresponding compensation stage through one pixel driving circuit having the threshold voltage compensation function, and to reduce the number of the TFTs desired for the threshold voltage compensation as well as the number of the data lines. As a result, it is able to remarkably increase an aperture ratio of the pixel unit and reduce the production cost, thereby to improve the image quality and the PPI.

Alternatively, the light-emitting element may be an OLED.

Figure 6:
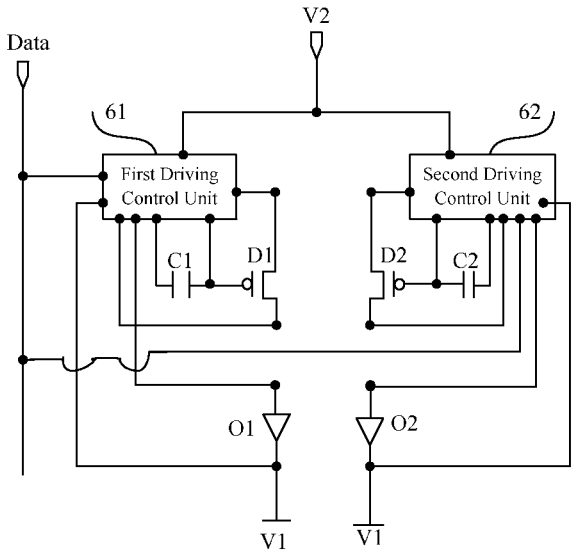
FIG. 6 is a block diagram of a pixel driving circuit according to a seventh embodiment of the present disclosure.

As shown in FIG. 6, the present disclosure provides in a seventh embodiment a pixel driving circuit for driving a first OLED O1 and a second OLED O2. Cathodes of the first OLED O1 and the second OLED O2 are configured to receive a first level V1. The pixel driving circuit includes a first pixel driving unit for controlling the first OLED O1 and a second pixel driving unit for controlling the second OLED O2.

The first pixel driving unit includes a first driving transistor D1, a first storage capacitor C1 and a first driving control unit 61. A first end of the first storage capacitor C1 is connected to a gate electrode of the first driving transistor D1, and a second end thereof is configured to receive a data voltage on a data line Data through the first driving control unit 61. The gate electrode of the first driving transistor D1 is connected to a first electrode of the first driving transistor D1 through the first driving control unit 61, the first electrode thereof is connected to an anode of the first OLED O1 through the first driving control unit 61, and a second electrode thereof is configured to receive a second level V2 through the first driving control unit 61.

The second pixel driving unit includes a second driving transistor D2, a second storage capacitor C2 and a second driving control unit 62. A first end of the second storage capacitor C2 is connected to a gate electrode of the second driving transistor D2, and a second end thereof is configured to receive the data voltage on the data line Data through the second driving control unit 62. The gate electrode of the second driving transistor D2 is connected to a first electrode of the second driving transistor D2 through the second driving control unit 62, the first electrode thereof is connected to an anode of the second OLED O2 through the second driving control unit 62, and a second electrode thereof is configured to receive the second level V2 through the second driving control unit 62.

For the pixel driving circuit in FIG. 6, D1 and D2 are both p-type TFTs, and at this time, the first level V1 is a low level and the second level V2 is a high level.

Alternatively, the first driving control unit may be of a structure identical to the second driving control unit.

Alternatively, the first driving control unit includes: a first control transistor, a gate electrode of which is configured to receive a first driving control signal, a first electrode of which is connected to the first electrode of the first driving transistor, and a second electrode of which is connected to the gate electrode of the first driving transistor; a second control transistor, a gate electrode of which is configured to receive the first driving control signal, a first electrode of which is configured to receive the data voltage, and a second electrode of which is connected to the second end of the first storage capacitor; a third control transistor, a gate electrode of which is configured to receive a first scanning signal, a first electrode of which is connected to the second electrode of the first driving transistor, and a second electrode of which is configured to receive the second level; and a fourth control transistor, a gate electrode of which is configured to receive a second scanning signal, a first electrode of which is connected to the second end of the first light-emitting element, and a second electrode of which is connected to the first electrode of the first driving transistor.

The second driving control unit includes: a fifth control transistor, a gate electrode of which is configured to receive a second driving control signal, a first electrode of which is connected to the first electrode of the second driving transistor, and a second electrode of which is connected to the gate electrode of the second driving transistor; a sixth control transistor, a gate electrode of which is configured to receive the second driving control signal, a first electrode of which is configured to receive the data voltage, and a second electrode of which is connected to the second end of the second storage capacitor; a seventh control transistor, a gate electrode of which is configured to receive the first scanning signal, a first electrode of which is connected to the second electrode of the second driving transistor, and a second electrode of which is configured to receive the second level; and an eighth control transistor, a gate electrode of which is configured to receive the second scanning signal, a first electrode of which is connected to the second end of the second light-emitting element, and a second electrode of which is connected to the first electrode of the second driving transistor.

To be specific, in the first pixel driving unit, the first driving transistor, the first control transistor, the second control transistor, the third control transistor and the fourth control transistor are all p-type TFTs, and in the second pixel driving unit, the second driving transistor, the fifth control transistor, the sixth control transistor, the seventh control transistor and the eighth control transistor are all p-type TFTs.

Figure 7:
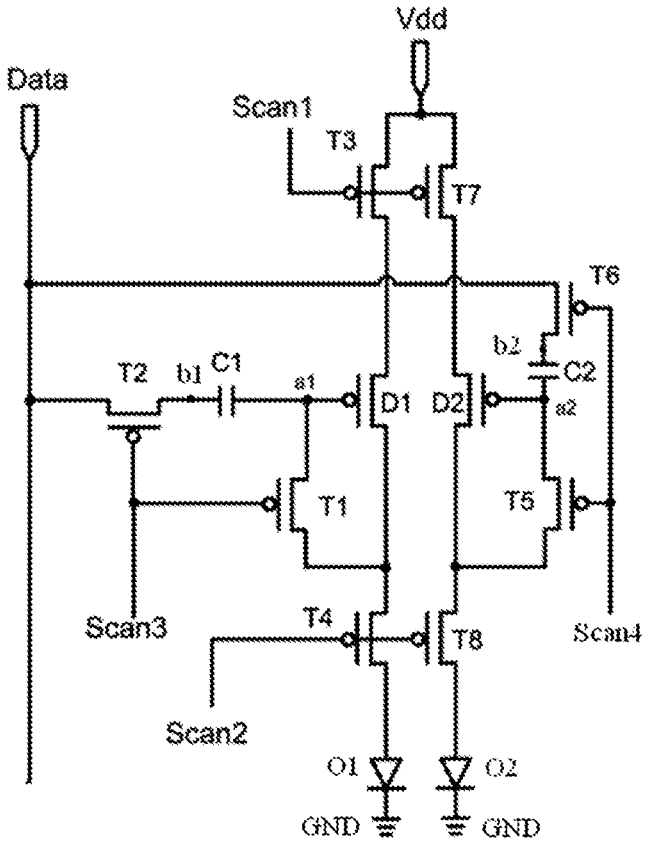
FIG. 7 is a circuit diagram of a pixel driving circuit according to a eighth embodiment of the present disclosure.

As shown in FIG. 7, the present disclosure provides in an eighth embodiment a pixel driving circuit for driving a first OLED O1 and a second OLED O2. Cathodes of the first OLED O1 and the second OLED O2 are both connected to the ground GND. The pixel driving circuit includes a first pixel driving unit for controlling the first OLED O1 and a second pixel driving unit for controlling the second OLED O2.

The first pixel driving unit includes a first driving transistor D1, a first storage capacitor C1 and a first driving control unit. A first end a1 of the storage capacitor C1 is connected to a gate electrode of the first driving transistor D1.

The first driving control unit includes: a first control transistor T1, a first electrode of which is connected to a first electrode of the first driving transistor D1, and a second electrode of which is connected to the gate electrode of the first driving transistor D1; a second control transistor T2, a first electrode of which is configured to receive a data voltage on a data line Data, and a second electrode of which is connected to a second end b1 of the first storage capacitor C1; a third control transistor T3, a gate electrode of which is configured to receive a first scanning signal Scan1, a first electrode of which is connected to a second electrode of the first driving transistor D1, and a second electrode of which is configured to receive a high level Vdd; and a fourth control transistor T4, a gate electrode of which is configured to receive a second scanning signal Scan2, a first electrode of which is connected to an anode of the first OLED O1, and a second electrode of which is connected to the first electrode of the first driving transistor D1.

The second pixel driving unit includes a second driving transistor D2, a second storage capacitor C2 and a second driving control unit. A first end a2 of the second storage capacitor C2 is connected to a gate electrode of the second driving transistor D2.

The second driving control unit includes: a fifth control transistor T5, a first electrode of which is connected to a first electrode of the second driving transistor D2, and a second electrode of which is connected to the gate electrode of the second driving transistor D2; a sixth control transistor T6, a first electrode of which is configured to receive the data voltage on the data line Data, and a second electrode of which is connected to a second end b2 of the second storage capacitor C2; a seventh control transistor T7, a gate electrode of which is configured to the first scanning signal Scan1, a first electrode of which is connected to a second electrode of the second driving transistor D2, and a second electrode of which is configured to receive the high level Vdd; and an eighth control transistor T8, a gate electrode of which is configured to receive the second scanning signal Scan2, a first electrode of which is connected to an anode of the second OLED O2, and a second electrode of which is connected to the first electrode of the second driving transistor D2.

In the first driving control unit, the gate electrodes T1 and T2 are both configured to receive a third scanning signal Scan3, and in the second driving control unit, the gate electrodes of T5 and T6 are both configured to receive a fourth scanning signal Scan4. T1, T2, T3, T4, T5, T6, T7, T8, D1 and D2 are all p-type TFTs.

In the pixel driving circuit as shown in FIG. 7, all the TFTs are p-type TFTs, so as to manufacture them by an identical process, thereby to improve the yield thereof.

As shown in FIG. 7, the two pixel driving units having the threshold compensation function are combined within one pixel driving circuit, and controlled by only one data line Data. T1, T2, T3, T4, T5, T6, T7 and T8 are all switching TFTs, D1 and D2 are driving TFTs for the pixels, and Scan1, Scan2, Scan3 and Scan4 are all scanning signals for controlling an on or off state of the switching TFTs.

An operating procedure of the pixel driving circuit in FIG. 7 will be described hereinafter.

Figure 8:
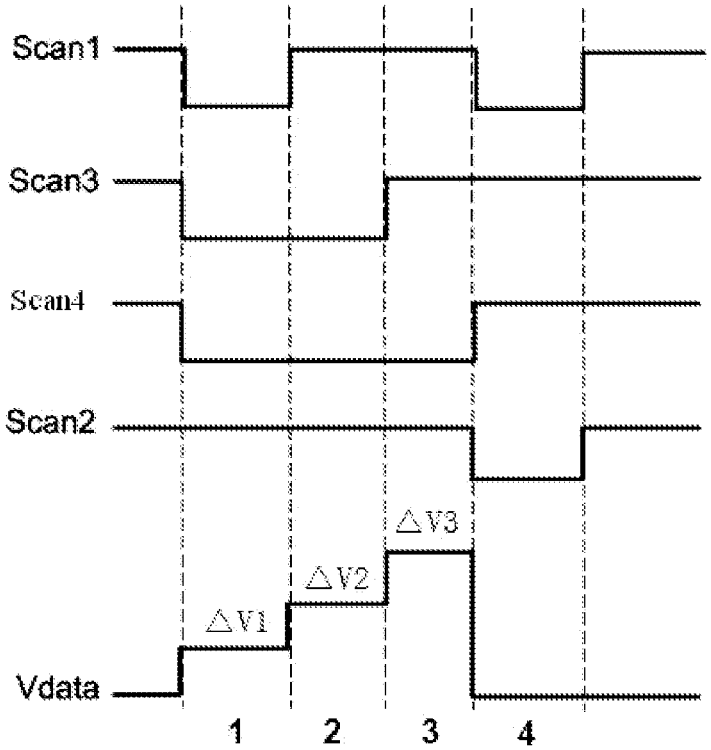
FIG. 8 is a time sequence diagram of the pixel driving circuit according to the eighth embodiment of the present disclosure.
Figure 9A:
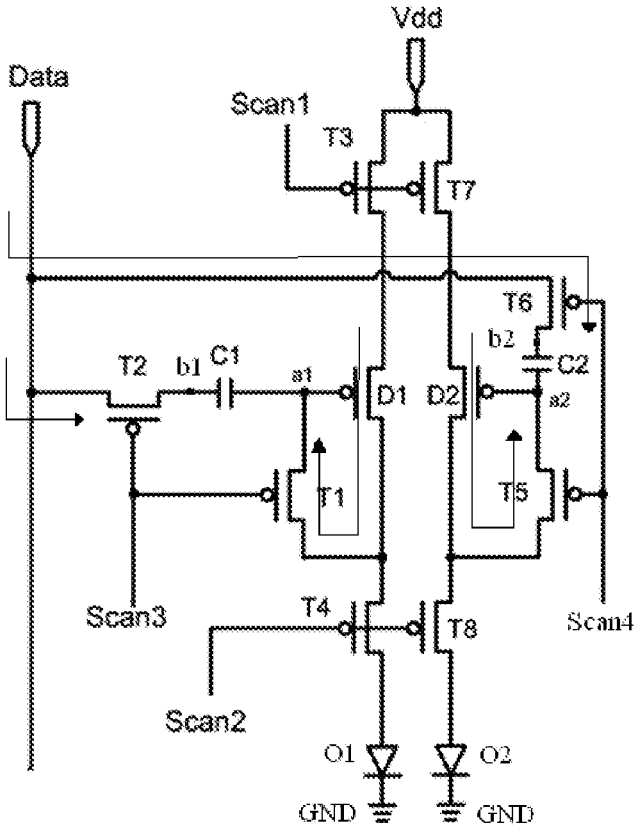
FIG. 9A is a view showing an operating state of the pixel driving circuit at a first stage according to the eighth embodiment of the present disclosure.

As shown in FIG. 8, at a first stage, i.e., a resetting and charging stage, Scan1, Scan3 and Scan4 are each a low level, and Scan2 is a high level. As shown in FIG. 9A, the TFTs other than T4 and T8 are turned on, and a1 is charged by Vdd through T3, D1 and T1 until a potential at a1 reaches Vdd−Vth1 (i.e., a voltage difference between a gate electrode and a source electrode of D1 is a threshold voltage Vth1 of D1). In this procedure, b1 is configured to receive the data voltage Vdata and a potential at b1 is ΔV1, so after the charging is completed, a potential difference between the two ends of C1 is always maintained at Vdd−Vth1−ΔV1. In addition, because T4 is turned off, no current flows through O1, and as a result, it is able to indirectly prolong a service life of O1. Identically, a potential different between the two ends of C1 in the other pixel driving unit is always maintained at Vdd−Vth2−ΔV1, where Vth2 is a threshold of D2.

Figure 9B:
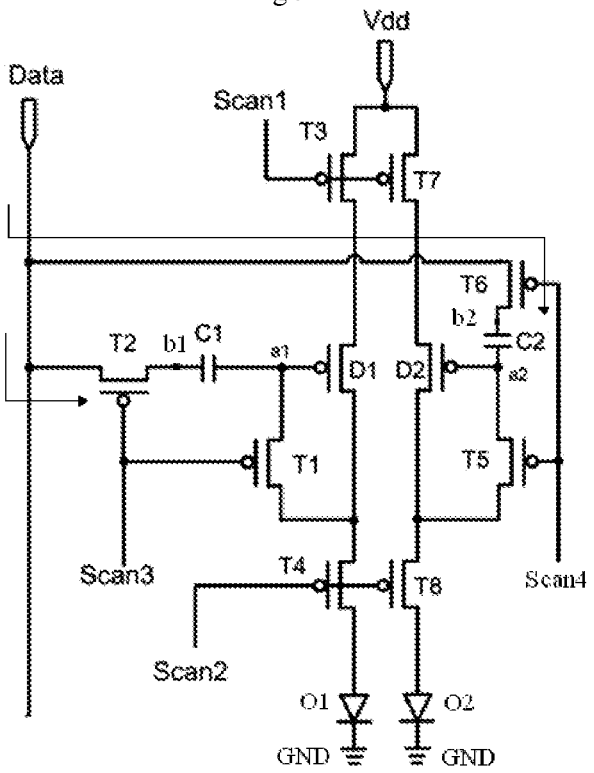
FIG. 9B is a view showing an operating state of the pixel driving circuit at a second stage according to the eighth embodiment of the present disclosure.

As shown in FIG. 8, at a second stage, i.e., a first compensation stage, Scan1 and Scan2 are each a high level, and Scan3 and Scan4 are each a low level. As shown in FIG. 9B, Vdata is jumped from ΔV1 at the first stage to ΔV2 at the second stage (V2 is greater than V1) and a1 is in a floating state, so a potential Va1 at a1 and a potential Vb1 at b1 are jumped equally (an original potential difference Vdd−Vth1−V1 is maintained). At this time, the potential Va1 at a1 is maintained at Vdd−Vth1+ΔV2−ΔV1. Identically, the potential Va2 at a2 is maintained at Vdd−Vth2+ΔV2−ΔV1.

Figure 9C:
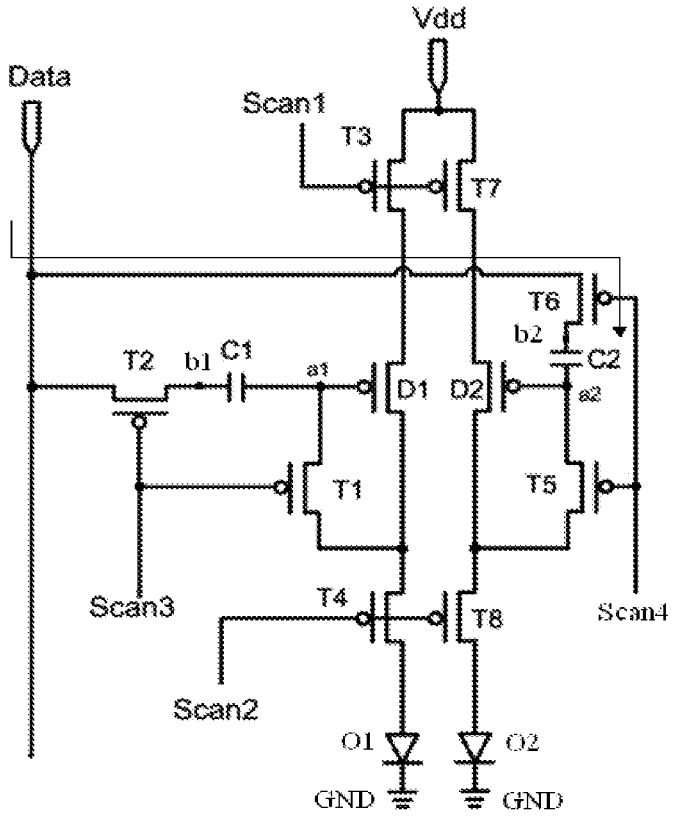
FIG. 9C is a view showing an operating state of the pixel driving circuit at a third stage according to the eighth embodiment of the present disclosure.

As shown in FIG. 8, at a third stage, i.e., a second compensation stage, Scan1, Scan2 and Scan3 are each a high level, and Scan4 is a low level. As shown in FIG. 9C, Vdata is jumped to V3 (V3 is greater than V2), and the potential Vb2 at the second end b2 of C2 is jumped from ΔV2 to ΔV3. Because a2 is in the floating state, Va2 and Vb2 are jumped equally (an original potential difference Vdd−Vth2−ΔV1 is maintained). At this time, the potential Va2 at a2 is maintained at Vdd−Vth2+ΔV3−ΔV1.

Figure 9D:
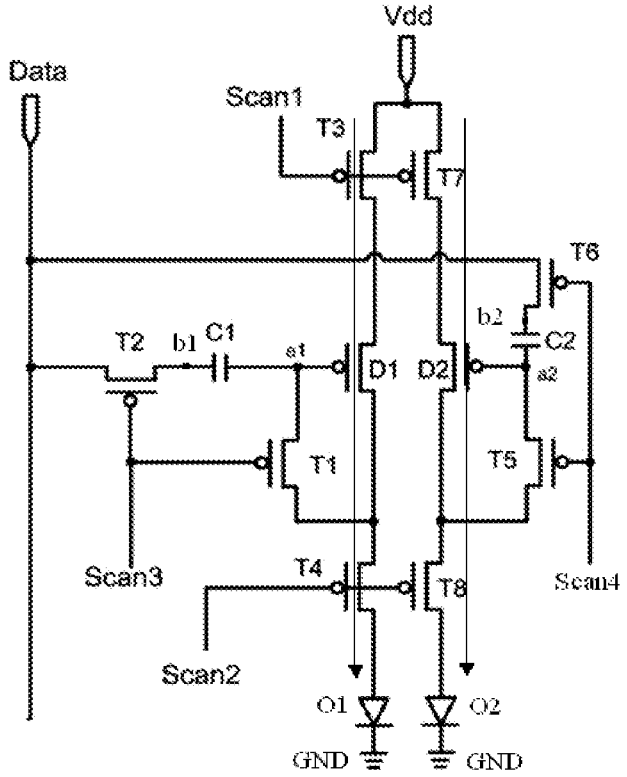
FIG. 9D is a view showing an operating state of the pixel driving circuit at a fourth stage according to the eighth embodiment of the present disclosure.

As shown in FIG. 8, at a fourth stage, i.e., a light-emitting stage, Scan1 and Scan2 are ach a low level, and Scan3 and Scan4 are each a high level. As shown in FIG. 9D, the OLED emits light after two voltage compensation stages and two jumping procedures, and FIG. 9D shows the on states of the TFTs. An operating voltage is Vdd, and the two pixels emit light through the respective paths. Based on a TFT saturation current equation, for a current $I_{O1}$ flowing through O1, $I_{O1}=K(V_{GS1}-Vth1)^2=K[Vdd-(Vdd-Vth1+\Delta V2-\Delta V1)-Vth1]^2=K(\Delta V2-\Delta V1)^2$, where K is a constant, and $V_{GS1}$ is a gate-source voltage of D1. Identically, a current $I_{O2}$ flowing through O2 is $K(\Delta V3-\Delta V1)^2$.

According to the pixel driving circuit in the embodiments of the present disclosure, the jumping voltage compensation is performed sequentially on a first pixel unit including the first OLED and a second pixel unit including the second OLED, and a jumping signal is applied onto Vdata, i.e., signal superposition and jumping are performed at different time domains, so as to achieve the pixel compensation. As a result, it is able to prevent the occurrence of uneven threshold voltages of the driving TFTs for the two pixel units due to limitations of the manufacture process and a long-term operation, and prevent the currents flowing through the OLEDS included in the two pixel units from being adversely affected by the threshold voltages of the driving transistors, thereby to ensure the even image display. In addition, no current flows through the OLED at the compensation stages and jumping stages, so it is able to prolong a service life of the OLED.

The present disclosure further provides in one embodiment a pixel driving method for driving the pixel driving circuit according to the fifth, sixth or seventh embodiment, which includes steps of:

at the resetting and charging stage within one time period, controlling by the first driving control unit the first end of the first storage capacitor to be charged to a difference between the second level and the threshold voltage of the first driving transistor and controlling the second end of the first storage capacitor to receive the data voltage, and controlling by the second driving control unit the first end of the second storage capacitor to be charged to a difference between the second level and the threshold voltage of the second driving transistor and controlling the second end of the second storage capacitor to receive the data voltage, the data voltage being ΔV1 at the resetting and charging stage;

at the first compensation stage within the time period, controlling by the first driving control unit the first end of the first storage capacitor to be in the floating state, thereby compensating for the threshold voltage of the first driving transistor through the gate-source voltage of the first driving transistor, the data voltage being jumped to ΔV2 at the first compensation stage;

at the second compensation stage within the time period, controlling by the second driving control unit the first end of the second storage capacitor to be in a floating state, thereby compensating for the threshold voltage of the second driving transistor through the gate-source voltage of the second driving transistor, the data voltage being jumped to ΔV3 at the second compensation stage; and at the light-emitting stage within the time period, controlling by the first driving control unit the first driving transistor to drive the first light-emitting element to emit light, and controlling by the second driving control unit the second driving transistor to drive the second light-emitting element to emit light.

Alternatively, when the driving transistors included in the pixel driving circuit are all p-type TFTs, ΔVE ΔV2 and ΔV3 are greater than 0, ΔV3 is greater than ΔV2, and ΔV2 is greater than ΔV1.

Figure 10:
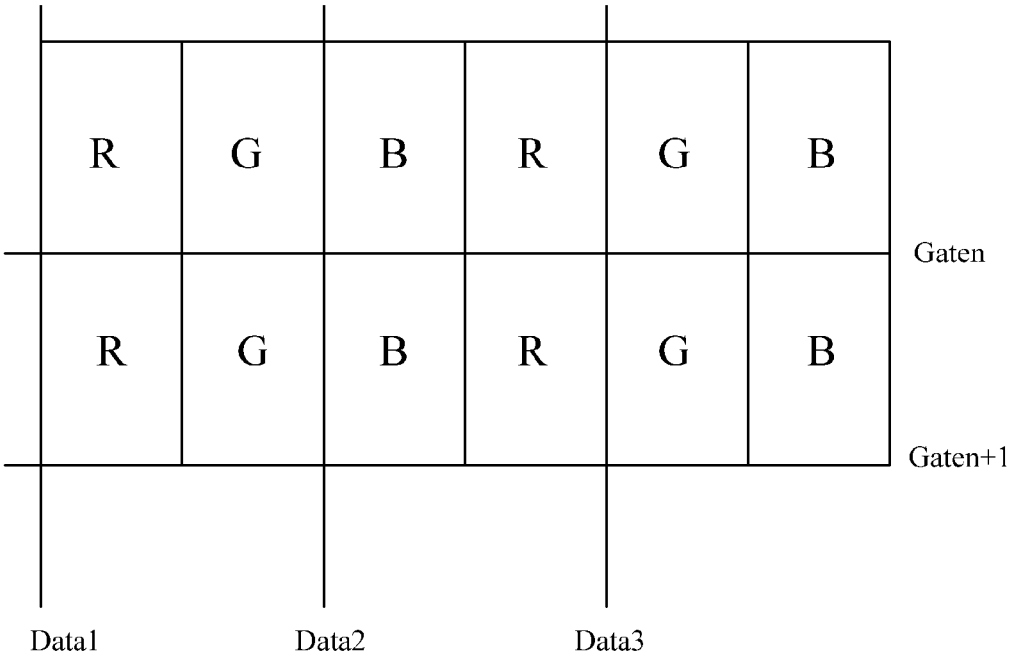
FIG. 10 is a schematic view showing a pixel circuit where a pixel driving circuit is arranged according to one embodiment of the present disclosure.

Different from the related art where each pixel unit is provided with a pixel driving circuit having the threshold compensation function, in the embodiments of the present disclosure, the pixel driving circuit as shown in FIG. 10 is arranged in two adjacent pixel units, and these two adjacent pixel units share a single data line. For example, as shown in FIG. 10, the pixel driving circuit may be arranged in a red pixel unit R and a green pixel unit G adjacent to each other, or in a green pixel unit G and a blue pixel unit B adjacent to each other.

The present disclosure further provides in one embodiment a display panel including the above-mentioned pixel driving circuit.

The present disclosure further provides in one embodiment a display device including the above-mentioned display panel. Alternatively, the display device may be an AMOLED display device.

The pixel driving circuit, the display panel and the display device in the embodiments of the present disclosure may be manufactured by a low temperature polysilicon (LTPS) technique, or an a-Si technique.

It should be appreciated that, the pixel driving circuit in the embodiments of the present disclosure may include a-Si, poly-Si or oxide TFTs, and the types of the TFTs in the pixel driving circuit may be changed in accordance with the practical need. In addition, although the above description is given by taking AMOLED as an example, the present disclosure is not limited thereto, and any other light-emitting diodes may also be used.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A pixel driving circuit for driving a first light-emitting element and a second light-emitting element, first ends of the first light-emitting element and the second light-emitting element being configured to receive a first level, wherein the pixel driving circuit comprises a first pixel driving unit and a second pixel driving unit, wherein the first pixel driving unit comprises a first driving transistor, a first storage capacitor and a first driving control unit;

a first end of the first storage capacitor is connected to a gate electrode of the first driving transistor, and a second end of the first storage capacitor is configured to receive a data voltage through the first driving control unit;

the gate electrode of the first driving transistor is connected to a first electrode of the first driving transistor through the first driving control unit, the first electrode of the first driving transistor is configured to receive a second level through the first driving control unit, and a second electrode of the first driving transistor is configured to receive the first level through the first driving control unit, the second electrode of the first driving transistor is further connected to a second end of the first light-emitting element; and the first driving control unit is configured to charge and discharge the first storage capacitor through the second level, the data voltage and the first level, so as to apply a jumping voltage onto the data voltage at a first compensation stage, thereby to perform jumping compensation on a threshold voltage of the first driving transistor and control the first light-emitting element to emit light; and wherein the second pixel driving unit comprises a second driving transistor, a second storage capacitor and a second driving control unit;

a first end of the second storage capacitor is connected to a gate electrode of the second driving transistor, and a second end of the second storage capacitor is configured to receive the data voltage through the first driving control unit;

the gate electrode of the second driving transistor is connected to a first electrode of the second driving transistor through the second driving control unit, the first electrode of the second driving transistor is configured to receive the second level through the second driving control unit, and a second electrode of the second driving transistor is configured to receive the first level through the second driving control unit, and the second electrode of the second driving transistor is further connected to a second end of the second light-emitting element; and the second driving control unit is configured to charge and discharge the second storage capacitor through the second level, the data voltage and the first level, so as to apply a jumping voltage onto the data voltage at a second compensation stage, thereby to perform jumping compensation on a threshold voltage of the second driving transistor and control the second light-emitting element to emit light.

2. The pixel driving circuit according to claim 1, wherein the first driving control unit is of a structure identical to the second driving control unit.

3. The pixel driving circuit according to claim 2, wherein the first driving control unit comprises:

a first control transistor, a gate electrode of which is configured to receive a first scanning signal, a, first electrode of which is connected to the first electrode of the first driving transistor, and a second electrode of which is connected to the gate electrode of the first driving transistor;

a second control transistor, a gate electrode of which is configured to receive the first scanning signal, a first electrode of which is connected to the second electrode of the first driving transistor, and a second electrode of which is configured to receive the first level;

a third control transistor, a gate electrode of which is configured to receive a first driving control signal, a first electrode of which is connected to the second end of the first storage capacitor, and a second electrode of which is configured to receive the data voltage; and a fourth control transistor, a gate electrode of which is configured to receive a second scanning signal, a first electrode of which is configured to receive the second level, and a second electrode of which is connected to the first electrode of the first driving transistor, and wherein the second driving control unit comprises:

a fifth control transistor, a gate electrode of which is configured to receive the first scanning signal, a first electrode of which is connected to the first electrode of the second driving transistor, and a second electrode of which is connected to the gate electrode of the second driving transistor;

a sixth control transistor, a gate electrode of which is configured to receive the first scanning signal, a first electrode of which is connected to the second electrode of the second driving transistor, and a second electrode of which is configured to receive the first level;

a seventh control transistor, a gate electrode of which is configured to receive a second driving control signal, a first electrode of which is connected to the second end of the second storage capacitor, and a second electrode of which is configured to receive the data voltage; and an eighth control transistor, a gate electrode of which is configured to receive the second scanning signal, a first electrode of which is configured to receive the second level, and a second electrode of which is connected to the first electrode of the second driving transistor.

4. The pixel driving circuit according to claim 3, wherein in the first pixel driving unit, the first driving transistor, the first control transistor, the second control transistor, the third control transistor and the fourth control transistor are all n-type thin film transistors (TFTs); and in the second pixel driving unit, the second driving transistor, the fifth control transistor, the sixth control transistor, the seventh control transistor and the eighth control transistor are all n-type TFTs.

5. The pixel driving circuit according to claim 1, wherein the first driving control unit comprises:

a first control transistor, a gate electrode of which is configured to receive a first scanning signal, a first electrode of which is connected to the first electrode of the first driving transistor, and a second electrode of which is connected to the gate electrode of the first driving transistor;

a second control transistor, a gate electrode of which is configured to receive the first scanning signal, a first electrode of which is connected to the second electrode of the first driving transistor, and a second electrode of which is configured to receive the first level;

a third control transistor, a gate electrode of which is configured to receive a first driving control signal, a first electrode of which is connected to the second end of the first storage capacitor, and a second electrode of which is configured to receive the data voltage; and a fourth control transistor, a gate electrode of which is configured to receive a second scanning signal, a first electrode of which is configured to receive the second level, and a second electrode of which is connected to the first electrode of the first driving transistor, and wherein the second driving control unit comprises:

a fifth control transistor, a gate electrode of which is configured to receive the first scanning signal, a first electrode of which is connected to the first electrode of the second driving transistor, and a second electrode of which is connected to the gate electrode of the second driving transistor;

a sixth control transistor, a gate electrode of which is configured to receive the first scanning signal, a first electrode of which is connected to the second electrode of the second driving transistor, and a second electrode of which is configured to receive the first level;

a seventh control transistor, a gate electrode of which is configured to receive the second scanning signal, a first electrode of which is connected to the second end of the second storage capacitor, and a second electrode of which is configured to receive the data voltage; and an eighth control transistor, a gate electrode of which is configured to receive the second scanning signal, a first electrode of which is configured to receive the second level, and a second electrode of which is connected to the first electrode of the second driving transistor.

6. The pixel driving circuit according to claim 5, wherein in the first pixel driving unit, the first driving transistor, the first control transistor, the second control transistor, the third control transistor and the fourth control transistor are all n-type TFTs; and in the second pixel driving unit, the second driving transistor, the fifth control transistor, the sixth control transistor and the eighth control transistor are all n-type TFTs, and the seventh control transistor is a p-type TFT.

7. The pixel driving circuit according to claim 2, wherein the first driving control unit comprises:

a first control transistor, a gate electrode of which is configured to receive a first scanning signal, a first electrode of which is connected to the first electrode of the first driving transistor, and a second electrode of which is connected to the gate electrode of the first driving transistor;

a second control transistor, a gate electrode of which is configured to receive the first scanning signal, a first electrode of which is connected to the second electrode of the first driving transistor, and a second electrode of which is configured to receive the first level;

a third control transistor, a gate electrode of which is configured to receive a first driving control signal, a first electrode of which is connected to the second end of the first storage capacitor, and a second end of which is configured to receive the data voltage; and a fourth control transistor, a gate electrode of which is configured to receive a second driving control signal, a first electrode of which is configured to receive the second level, and a second electrode of which is connected to the first electrode of the first driving transistor, and wherein the second driving control unit comprises:

a fifth control transistor, a gate electrode of which is configured to receive the first scanning signal, a first electrode of which is connected to the first electrode of the second driving transistor, and a second electrode of which is connected to the gate electrode of the second driving transistor;

a sixth control transistor, a gate electrode of which is configured to receive the first scanning signal, a first electrode of which is connected to the second electrode of the second driving transistor, and a second electrode of which is configured to receive the first level;

a seventh control transistor, a gate electrode of which is configured to receive the second driving control signal, a first electrode of which is connected to the second end of the second storage capacitor, and a second electrode of which is configured to receive the data voltage; and an eighth control transistor, a gate electrode of which is configured to receive the second driving control signal, a first electrode of which is configured to receive the second level, and a second electrode of which is connected to the first electrode of the second driving transistor.

8. The pixel driving circuit according to claim 7, wherein in the first pixel driving unit, the first driving transistor, the first control transistor, the second control transistor and the third control transistor are all n-type TFTs, and the fourth control transistor is a p-type TFT; and in the second pixel driving unit, the second driving transistor, the fifth control transistor, the sixth control transistor and the seventh control transistor are all n-type TFTs, and the eighth control transistor is a p-type TFT.

9. A pixel driving circuit for driving a first light-emitting element and a second light-emitting element, first ends of the first light-emitting element and the second light-emitting element being configured to receive a first level, wherein the pixel driving circuit comprises a first pixel driving unit and a second pixel driving unit;

wherein the first pixel driving unit comprises a first driving transistor, a first storage capacitor and a first driving control unit;

a first end of the first storage capacitor is connected to a gate electrode of the first driving transistor, and a second end of the first storage capacitor is configured to receive a data voltage through the first driving control unit;

the gate electrode of the first driving transistor is connected to a first electrode of the first driving transistor through the first driving control unit, the first electrode of the first driving transistor is connected to a second end of the first light-emitting element through the first driving control unit, and a second electrode of the first driving transistor is configured to receive a second level through the first driving control unit;

the first driving control unit is configured to reset and charge the first storage capacitor through the second level and the data voltage, so as to apply a jumping voltage onto the data voltage at a first compensation stage, thereby to perform jumping compensation on a threshold voltage of the first driving transistor and control the first driving transistor to drive the first light-emitting element to emit light, and wherein the second pixel driving unit comprises a second driving transistor, a second storage capacitor and a second driving control unit;

a first end of the second storage capacitor is connected to a gate electrode of the second driving transistor, and a second end of the second storage capacitor is configured to receive the data voltage through the second driving control unit;

the gate electrode of the second driving transistor is connected to a first electrode of the second driving transistor through the second driving control unit, the first electrode of the second driving transistor is connected to a second end of the second light-emitting element through the second driving control unit, and a second electrode of the second driving transistor is configured to receive the second level through the second driving control unit; and the second driving control unit is configured to reset and charge the second storage capacitor through the second level and the data voltage, so as to apply a jumping voltage onto the data voltage at a second compensation stage, thereby to perform jumping compensation on a threshold voltage of the second driving transistor and control the second driving transistor to drive the second light-emitting element to emit light.

10. The pixel driving circuit according to claim 9, wherein the first driving control unit is of a structure identical to the second driving control unit.

11. The pixel driving circuit according to claim 10, wherein the first driving control unit comprises:

a first control transistor, a gate electrode of which is configured to receive a first driving control signal, a first electrode of which is connected to the first electrode of the first driving transistor, and a second electrode of which is connected to the gate electrode of the first driving transistor;

a second control transistor, a gate electrode of which is configured to receive the first driving control signal, a first electrode of which is configured to receive the data voltage, and a second electrode of which is connected to the second end of the first storage capacitor;

a third control transistor, a gate electrode of which is configured to receive a first scanning signal, a first electrode of which is connected to the second electrode of the first driving transistor, and a second electrode of which is configured to receive the second level; and a fourth control transistor, a gate electrode of which is configured to receive a second scanning signal, a first electrode of which is connected to the second end of the first light-emitting element, and a second electrode of which is connected to the first electrode of the first driving transistor, and wherein the second driving control unit comprises:

a fifth control transistor, a gate electrode of which is configured to receive a second driving control signal, a first electrode of which is connected to the first electrode of the second driving transistor, and a second electrode of which is connected to the gate electrode of the second driving transistor;

a sixth control transistor, a gate electrode of which is configured to receive the second driving control signal, a first electrode of which is configured to receive the data voltage, and a second electrode of which is connected to the second end of the second storage capacitor;

a seventh control transistor, a gate electrode of which is configured to receive the first scanning signal, a first electrode of which is connected to the second electrode of the second driving transistor, and a second electrode of which is configured to receive the second level; and an eighth control transistor, a gate electrode of which is configured to receive the second scanning signal, a first electrode of which is connected to the second end of the second light-emitting element, and a second electrode of which is connected to the first electrode of the second driving transistor.

12. The pixel driving circuit according to claim 11, wherein in the first pixel driving unit, the first driving transistor, the first control transistor, the second control transistor, the third control transistor and the fourth control transistor are all p-type thin film transistors (TFTs); and in the second pixel driving unit, the second driving transistor, the fifth control transistor, the sixth control transistor, the seventh control transistor and the eighth control transistor are all p-type TFTs.

13. A pixel driving method for driving the pixel driving circuit according to claim 1, comprising steps of:

at a charging stage within one time period, controlling, by a first driving control unit, a first end of a first storage capacitor to be charged to a second level, and controlling, by a second driving control unit, a first end of a second storage capacitor to be charged to the second level;

at a discharging stage within the time period, controlling, by the first driving control unit, the first end of the first storage capacitor to be discharged to a threshold voltage of a first driving transistor and controlling a second end of the first storage capacitor to receive a data voltage, and controlling, by the second driving control unit, the first end of the second storage capacitor to be discharged to a threshold voltage of a second driving transistor and controlling a second end of the second storage capacitor to receive the data voltage, the data voltage being V0 at the discharging stage;

at a first compensation stage within the time period, controlling, by the first driving control unit, the second end of the first storage capacitor to receive the data voltage, and controlling the first end of the first storage capacitor to be in a floating state, thereby compensating for a threshold voltage of the first driving transistor through a gate-source voltage of the first driving transistor, the data voltage being jumped to V0+ΔV1 at the first compensation stage;

at a second compensation stage within the time period, controlling, by the second driving control unit, the second end of the second storage capacitor to receive the data voltage and controlling the first end of the second storage capacitor to be in a floating state, thereby compensating for a threshold voltage of the second driving transistor through a gate-source voltage of the second driving transistor, the data voltage being jumped to V0+ΔV2 at the second compensation stage; and at a light-emitting stage within the time period, controlling, by the first driving control unit, the first driving transistor to drive a first light-emitting element to emit light, and controlling, by the second driving control unit, the second driving transistor to drive a second light-emitting element to emit light.

14. The method according to claim 13, wherein when the driving transistors included in the pixel driving circuit are all n-type thin film transistors (TFTs), V0, ΔV1 and ΔV2 are greater than 0, and ΔV2 is greater than ΔV1.

15. A pixel driving method for driving the pixel driving circuit according to claim 9, comprising steps of:

at a resetting and charging stage within one time period, controlling, by a first driving control unit, a first end of a first storage capacitor to be charged to a difference between a second level and a threshold voltage of a first driving transistor and controlling a second end of the first storage capacitor to receive a data voltage, and controlling, by a second driving control unit, a first end of a second storage capacitor to be charged to a difference between the second level and a threshold voltage of a second driving transistor and controlling a second end of the second storage capacitor to receive the data voltage, the data voltage being ΔV1 at the resetting and charging stage;

at a first compensation stage within the time period, controlling, by the first driving control unit, the first end of the first storage capacitor to be in a floating state, thereby compensating for the threshold voltage of the first driving transistor through a gate-source voltage of the first driving transistor, the data voltage being jumped to ΔV2 at the first compensation stage;

at a second compensation stage within the time period, controlling, by the second driving control unit, the first end of the second storage capacitor to be in a floating state, thereby compensating for the threshold voltage of the second driving transistor through a gate-source voltage of the second driving transistor, the data voltage being jumped to ΔV3 at the second compensation stage; and at a light-emitting stage within the time period, controlling, by the first driving control unit, the first driving transistor to drive a first light-emitting element to emit light, and controlling, by the second driving control unit, the second driving transistor to drive a second light-emitting element to emit light.

16. The method according to claim 15, wherein when the driving transistors included in the pixel driving circuit are all p-type thin film transistors (TFTs), ΔV1, ΔV2 and ΔV3 are greater than 0, ΔV3 is greater than ΔV2, and ΔV2 is greater than ΔV1.

17. A display panel comprising the pixel driving circuit according to claim 1.

18. A display device comprising the display panel according to claim 17.

19. A display panel comprising the pixel driving circuit according to claim 9.

20. A display device comprising the display panel according to claim 19.

* * * * *